US006514014B1

(12) United States Patent
Holmes et al.

(10) Patent No.: US 6,514,014 B1
(45) Date of Patent: Feb. 4, 2003

(54) METHOD AND APPARATUS FOR COLLECTING AND TRANSPORTING CIGARETTES AND CIGARETTE REJECTS

(75) Inventors: Gregory Alan Holmes, Winston-Salem, NC (US); Philip Andrew Deal, Winston-Salem, NC (US); David Wayne Tatum, Lexington, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 86 days.

(21) Appl. No.: 09/676,442

(22) Filed: Sep. 29, 2000

(51) Int. Cl.[7] ..... B65G 53/40

(52) U.S. Cl. ..... 406/75; 406/122; 406/151; 131/109.3; 131/110

(58) Field of Search ..... 406/75, 122, 145, 406/151, 109.3; 131/110

(56) References Cited

U.S. PATENT DOCUMENTS

| | | | | |
|---|---|---|---|---|
| 1,858,328 A | * | 5/1932 | Heymann et al. | 198/770 |
| 2,000,484 A | * | 5/1935 | James | 193/11 |
| 2,339,605 A | * | 1/1944 | Patterson | 131/22 |
| 3,026,880 A | | 3/1962 | Perrin | |
| 3,103,222 A | | 9/1963 | Di Ianni | |
| 3,224,451 A | | 12/1965 | Dearsley | |
| 3,386,320 A | | 6/1968 | Pinkham et al. | |
| 3,577,999 A | | 5/1971 | Pinkham | |
| 3,583,447 A | | 6/1971 | Peterson | |
| 3,690,484 A | | 9/1972 | Harlan et al. | |
| 3,757,799 A | | 9/1973 | Di Ianni et al. | |
| 4,002,255 A | | 1/1977 | Fincham et al. | |
| 4,036,380 A | | 7/1977 | Berry et al. | |
| 4,083,499 A | | 4/1978 | Thatcher | |
| 4,117,852 A | | 10/1978 | Newman et al. | |
| 4,191,199 A | | 3/1980 | Sullivan | |
| 4,221,035 A | | 9/1980 | Thatcher | |
| 4,261,790 A | | 4/1981 | Brinker et al. | |
| 4,278,100 A | | 7/1981 | Thatcher | |
| 4,390,029 A | * | 6/1983 | Leckband et al. | 131/109 AB |
| 4,485,827 A | | 12/1984 | Komossa et al. | |
| 4,576,526 A | * | 3/1986 | Muller et al. | 406/75 |
| 4,622,875 A | | 11/1986 | Emery et al. | |
| 4,843,801 A | | 7/1989 | Roncero | |
| 4,867,179 A | | 9/1989 | Leonard | |
| 5,001,951 A | | 3/1991 | Eisenlohr et al. | |
| 5,086,790 A | | 2/1992 | Greene, Jr. | |
| 5,117,843 A | | 6/1992 | Holmes et al. | |
| 5,148,816 A | * | 9/1992 | Heitmann | 131/84.1 |
| 5,234,007 A | | 8/1993 | Holmes et al. | |
| 5,337,762 A | * | 8/1994 | Jedamski | 131/108 |
| 5,806,531 A | * | 9/1998 | Diehl et al. | 131/110 |

FOREIGN PATENT DOCUMENTS

| | | |
|---|---|---|
| EP | 0 118 289 A2 | 9/1984 |

* cited by examiner

*Primary Examiner*—Christopher P. Ellis
*Assistant Examiner*—Joe Dillon, Jr.

(57) ABSTRACT

An apparatus for receiving and transporting cigarette rejects in a cigarette manufacturing process comprises a receptacle having a receiving opening and an insertion opening for receiving rejects, a conduit having a first end and a second end and communicating with the insertion opening, and means for providing a fluid flow in the conduit for transporting the rejects. A method of collecting and transporting cigarette rejects in a cigarette manufacturing process comprises directing the rejects into a fluid stream whereby such rejects may be transported transporting the rejects in the fluid stream to a predetermined location in the cigarette manufacturing process, and separating the rejects from the fluid stream.

5 Claims, 17 Drawing Sheets

METHOD AND APPARATUS FOR COLLECTING AND TRANSPORTING CIGARETTES AND CIGARETTE REJECTS

FIELD OF THE INVENTION

The present invention relates to a method and apparatus for collecting and transporting cigarette rejects in a cigarette manufacturing process. The method and apparatus of the present invention are particularly useful for transporting cigarette rejects from a cigarette filter tipping machine to a cigarette opener and tobacco removal unit.

BACKGROUND OF THE INVENTION

The production of cigarettes is a highly automated process involving sophisticated machinery for handling tobacco, paper and filter elements and forming cigarette products. Cigarettes can vary in composition and construction. Typically, cigarettes comprise a rod of smokable material, such as a blend of shredded tobacco laminae, volume expanded shredded tobacco laminae, cut and processed tobacco stems, shredded reconstituted tobacco, and the like. The smokable material or cut filler is circumscribed by an outer wrapping material such as cigarette paper, e.g., a calcium carbonate and flax paper, thereby forming a tobacco rod. Tobacco rods typically have lengths of about 40 mm to about 85 mm; preferably about 55 mm to 70 mm, and circumferences of about 17 to about 27 mm, preferably about 22 mm to about 25 mm. For filter cigarettes, a filter element normally manufactured from plasticized cellulose acetate tow and circumscribed by a paper plug wrap is attached to one end of the tobacco rod. Filter elements can have flavors incorporated therein, contain charcoal, or the like. Filter elements typically have lengths of about 10 mm to about 40 mm, preferably about 15 to about 35 mm; and have circumferences comparable to that of the tobacco rod to which they are attached. A tipping paper typically circumscribes the filter element and an adjacent region of the tobacco rod so as to fixedly secure the filter element to the tobacco rod. Typical filter cigarettes are about 80 mm, about 85 mm and about 100 mm in length.

Cigarettes conventionally have been sold in packages called "packs," and each pack normally contains 20 cigarettes. The cigarettes are usually arranged in a matrix of three rows having 7 cigarettes, 6 cigarettes and 7 cigarettes, respectively. Cigarette packs are packaged in cartons, typically ten packs per carton.

During the manufacture of cigarettes, a number of "cigarette rejects" are produced. As used herein, the term "cigarette rejects" includes both acceptable cigarettes (i.e., cigarettes that meet manufacturing and other quality standards), defective cigarettes and any portions thereof. As set forth below, "cigarette rejects," for example, might include cigarettes rejected at a cigarette rod making machine, cigarettes rejected at a filter tipping machine, cigarettes discarded at the start or end of a production run or when a machine goes down, and cigarettes from rejected pack or cartons.

In the manufacture of cigarettes, tobacco is supplied to a cigarette rod making machine by a hopper. The cigarette rod making machine forms rods of smokable material, wrapped in a tube of cigarette paper. "Long ends," which are produced during the startup of the rod making machine, and defective cigarette rods are manually removed by the operator and transported to a cigarette opener and tobacco removal unit, described below.

The cigarette rod making machine is directly coupled with a filter tipping machine, which affixes filters to the ends of the cigarette rods. Finished cigarettes are inspected and those meeting the appropriate quality standards are transported by conveyor to a cigarette storage and retrieval unit. For example, the pressure drop across each cigarette is measured at the cigarette tipping machine. Cigarettes with pressure drops outside of an acceptable range are rejected. Under conventional techniques, defective cigarettes fall from the tipping machine into a container or bin. Periodically, the operator of the cigarette tipping machine is required to empty the bin. The cigarette rejects become waste material and the tobacco is separated and used in reconstituted tobacco products. However, an operator may carry the bin of rejected cigarettes from the cigarette tipping machine to the cigarette opener and tobacco removal unit.

Cigarettes meeting test criteria are transported to a storage and retrieval unit. From the storage and retrieval unit, the cigarettes are transported to a packer unit. After the cigarettes are packaged in individual packs, the cigarette packs are inspected and those found meeting the appropriate quality standards are transported to a sealing film wrap and cartoner unit, where the packs are wrapped in a polymeric film, such as polyethylene or polypropylene, sealed and cartoned. Packs which are found defective in the packer may be transported to a pack opener unit or become waste material and treated similarly to cigarette rejects from the tipping machine. In addition, improperly cartoned or sealing film-wrapped packs can be transported manually to the hopper for the pack opener unit. The cigarettes in these defective packs or cartons may be transported to a cigarette opener and tobacco removal unit after being removed from the packs.

As a result of the various rejection points for cigarettes and packs in the manufacturing process discussed above, substantial quantities of tobacco may be removed as waste material. This requires the separation of the tobacco from the non-tobacco materials. The tobacco from the cigarette rejects is normally used in by-product materials such as reconstituted tobaccos. It has been a desire of the industry to reclaim the tobacco at the various rejection points in the manufacturing process and return it directly to the tobacco supply for the cigarette making machine for a number of reasons. Typically, each cigarette has a unique blend of various types of tobaccos, stems, expanded tobacco, etc. Such blended tobacco is the most expensive component of the cigarette. If the rejected tobacco could be returned to the cigarette maker tobacco supply which is being used to manufacture the same blend of cigarettes, great savings would ensue.

Furthermore, the tobacco from menthol cigarettes cannot be reclaimed in the normal process with other tobaccos because the menthol will contaminate the other tobaccos. Thus, it cannot be used in reconstituted by-products unless the menthol is removed from the tobacco. This is an expensive process so, typically, the menthol tobacco has been discarded. There have been numerous attempts to provide methods and systems for in-line tobacco reclamation in the cigarette manufacturing process at the cigarette maker and at the packer, such as that shown in U.S. Pat. No. 5,117,843.

Although an effective cigarette opener and tobacco removal unit for removing tobacco from individual cigarettes has been developed (for example, a unit manufactured by Decouffle) and an effective pack opener unit for removal of cigarettes from a pack (for example, U.S. Pat. No. 5,234,007) has been developed, the reclamation process still requires that the rejected cigarettes from the maker and/or tipper be manually introduced into the cigarette opener and tobacco removal unit.

The present invention provides a method and a means for moving cigarette rejects from the cigarette manufacturing process to the cigarette opener and tobacco removal unit.

Additionally, a disadvantage of many current cigarette production processes is that operator intervention is required to return defective cigarettes, or cigarette rods, to a tobacco removal unit for tobacco recovery. This need for operator intervention disrupts an otherwise completely automated process and may accordingly reduce the production efficiency of the process.

SUMMARY OF THE INVENTION

The present invention provides a method and apparatus for collecting and transporting cigarette rejects in a cigarette manufacturing process. In one embodiment, an apparatus for collecting and transporting cigarette rejects in a cigarette manufacturing process comprises means for directing the rejects into a fluid stream whereby such rejects may be transported, means for transporting the rejects in the fluid stream to a predetermined location in the cigarette manufacturing process and means for separating the rejects from the fluid stream. In a further embodiment, the means for directing the rejects into a fluid stream comprise a receptacle having two end walls and two side walls. The lower portions of the end walls and side walls form an insertion opening and the upper portions of the end walls and side walls form a receiving opening. The means for transporting the cigarette rejects to a predetermined location in the cigarette manufacturing process (e.g., a cigarette opener and tobacco removal unit) may comprise a conduit having a first end and a second end with a blower at the first end of the conduit and a vacuum generator at the second end of the conduit. The predetermined location in the cigarette manufacturing process may be a cigarette opener and tobacco removal unit.

In another embodiment, the means for directing the rejects into a fluid stream comprise a funneling tray, a trough comprising at least two segments and having a first end and a second end, and a first driver attached to a first trough segment. The trough is preferably V-shaped. In a preferred embodiment, the second trough segment includes a first section and a second section with a second driver attached to a second trough segment. The first trough segment is substantially horizontal and overlays the second trough segment. The first section of the second trough segment is also substantially horizontal while the second section of the second trough segment has a steeper pitch than the first section. In this embodiment, the means for transporting the rejects preferably comprises a vacuum generator positioned near the second end of the trough.

Another embodiment for an apparatus for receiving and transporting cigarette rejects in a cigarette manufacturing process comprises a receptacle having a receiving opening and an insertion opening for receiving cigarette rejects, a conduit having a first end and a second end and communicating with the insertion opening, and means for providing a fluid flow in the conduit for transporting the rejects. In a further embodiment, the receptacle comprises first and second end walls and first and second side walls between the end walls, such that the lower portions of the end walls and side walls form the insertion opening and the upper portions of the end walls and side walls form the receiving opening. The insertion opening is preferably smaller than the receiving opening. A horizontally-aligned fluid divider is preferably positioned in the conduit. Alternatively, a U-shaped fluid divider may be positioned in the conduit. In a preferred embodiment, the means for providing a fluid flow in the conduit comprise a blower at the first end of the conduit and a vacuum generator at the second end of the conduit. The receptacle and the conduit are preferably constructed from stainless steel and the hose is preferably nylon.

An apparatus for receiving and transporting cigarette rejects in a cigarette manufacturing process may further comprise means for metering the rejects before the rejects are received in the receptacle. In one embodiment, the metering means comprise a diverter resting on the receptacle. Compressed air jets, which may be pulsed manually or automatically, may be positioned inside the receptacle above the first opening. In another embodiment, the metering means comprise a vibrating sifter, which may include a bracket, at least one spring disposed on the bracket, an upper plate resting on the at least one spring, and a vibrator attached to the upper plate.

Another embodiment of an apparatus of the present invention comprises a funneling tray, a trough comprising at least two trough segments and having a first end and a second end, a first driver attached to a first trough segment, and a vacuum generator positioned near the second end of the trough. The funneling tray guides the cigarette rejects into the trough. The first driver vibrates the first trough segment to mechanically convey the cigarette rejects toward the vacuum generator. The vacuum generator transports the cigarette rejects to a predetermined location in the cigarette manufacturing process. This embodiment preferably comprises a second trough segment having two sections, configured such that the first trough segment is substantially horizontal and overlays the second trough segment. The first section of the second trough segment is substantially horizontal while the second section of the second trough segment has a steeper pitch than the first section. A second driver is preferably attached to the second trough segment and vibrates the second trough segment to mechanically convey the cigarette rejects toward the vacuum generator. In a preferred embodiment, the trough and the trough segments are V-shaped although other cross-sections may be used. A waste pan preferably rests on the trough, particularly when the apparatus is positioned below a filter tipping machine, to collect filter and paper waste.

When an apparatus of the present invention utilizes air as a fluid stream, the apparatus may also be referred to as a pneumatic cigarette conveyor.

The present invention also relates to a method of collecting and transporting cigarette rejects in a cigarette manufacturing process. A method of the present invention comprises directing the rejects into a fluid stream whereby such rejects may be transported, transporting the rejects in the fluid stream to a predetermined location in the cigarette manufacturing process, and separating the rejects from the fluid stream.

In one embodiment, directing the rejects into a fluid stream comprises receiving the rejects from the manufacturing process, conveying the rejects toward an insertion opening and introducing the rejects to the fluid stream through the insertion opening. A receptacle having two end walls and two side walls is provided to receive the rejects. The lower portions of the end walls and side walls form the insertion opening and the upper portions of the end walls and side walls form a receiving opening. The fluid stream is preferably air, which may be generated by a blower at the first end wall of the receptacle and a vacuum generator at the second end wall of the receptacle. The predetermined location in the cigarette manufacturing process is preferably a cigarette opener and tobacco removal unit.

In a further embodiment of a method of the present invention, directing the rejects further comprises metering the rejects from the manufacturing process. In one embodiment, the rejects are metered by a diverter and compressed air jets positioned inside the receptacle above the insertion opening. In another embodiment, the rejects are metered by a vibrating sifter. A vibrating sifter may comprise a bracket, at least one spring disposed on the bracket, an upper plate having at least one plate opening resting on the at least one spring, and a vibrator attached to the upper plate.

In another embodiment of a method of collecting and transporting cigarette rejects in a cigarette manufacturing process, directing the rejects into a fluid stream comprises receiving the rejects from the manufacturing process, guiding the rejects into a trough, and conveying the rejects toward a vacuum generator to introduce the rejects to the fluid stream. The trough is preferably V-shaped and comprises at least two trough segments, preferably having different pitches. The first trough segment is substantially horizontal and overlays the second trough segment. The second trough segment preferably has two sections. The first section of the second trough segment is preferably horizontal while the second section has a steeper pitch than the first. A first driver is attached to the first trough segment and a second driver is attached to the second trough segment. The drivers vibrate the trough segments such that the cigarette rejects are mechanically conveyed towards the vacuum generator.

An advantage of the present invention is that cigarette rejects can be collected and transported to a tobacco removal unit with minimal observation and assistance by operators. A further advantage of the present invention is that the apparatus operates continuously while prior modes of operation and processes were batch operations, where operators periodically emptied plastic tubs of rejected cigarettes.

A further advantage of the present invention is that the apparatus has fewer components, and essentially no moving parts, which results in a less costly design than conventional belt conveyors. Additionally, the present invention requires less maintenance than a conventional conveyor because the apparatus uses no belting materials, no bearings, no. chains and no gear motors.

A still further advantage of the present invention is that the use of the apparatus results in low handling and hence low tobacco degradation and waste of the smokable material. Because the reclamation and recycling of tobacco is contemporaneous with the making of cigarettes and is relatively fast, moisture loss is low, resulting in no reconditioning of the tobacco being required. Thus, the reclaimed tobacco that is returned to the hopper has substantially the same predetermined moisture content as the tobacco in the hopper. Typical moisture content of tobacco filler material is 10% to 15%, preferably 12% to 13% during cigarette manufacture.

With the foregoing and other advantages and features of the invention that will become hereinafter apparent, the nature of the invention may be more clearly understood by reference to the following detailed description of the invention, the appended claims and to the several views illustrated in the drawings.

DETAILED DESCRIPTION OF THE INVENTION

Figure 1:
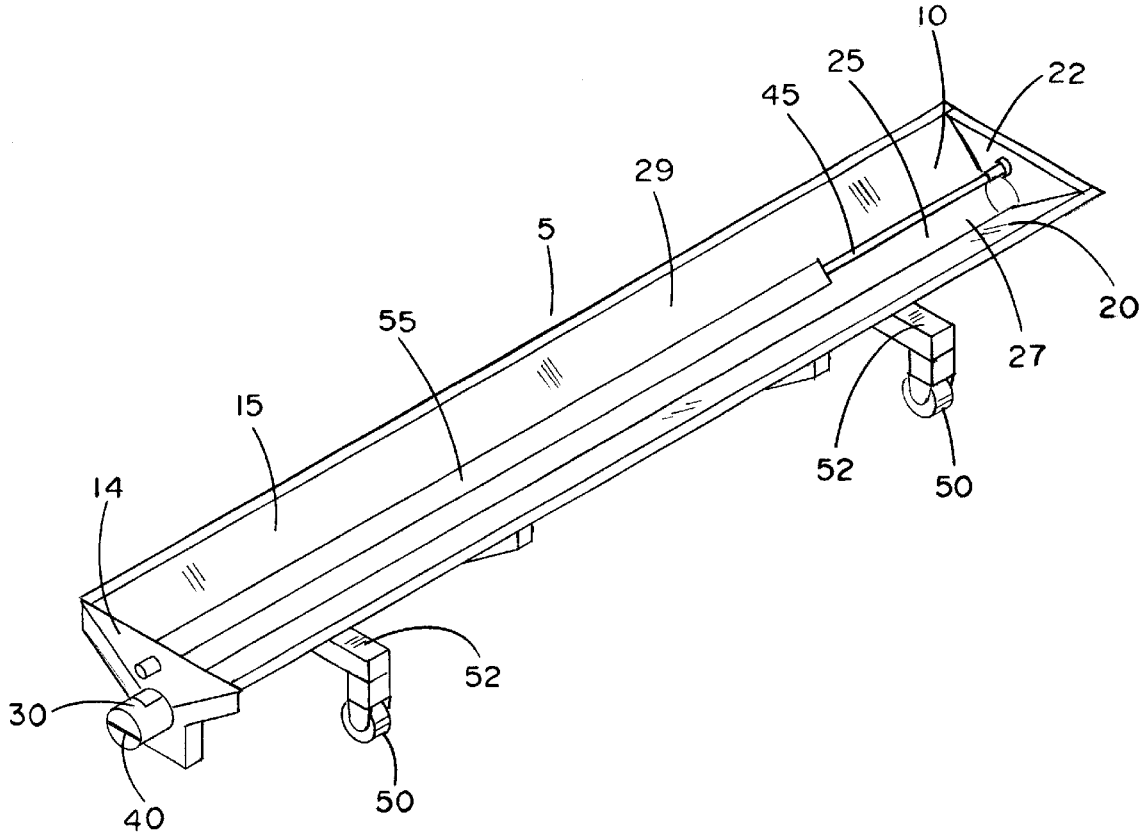
FIG. 1 is a perspective view of an apparatus according to the present invention.

The present invention relates to a method and apparatus for collecting and transporting cigarette rejects in a cigarette manufacturing process. The production of cigarettes results in a number of cigarette rejects. As used herein, the term "cigarette rejects" includes both acceptable cigarettes (i.e., cigarettes that meet manufacturing and other quality standards), defective cigarettes and any portions thereof.

"Cigarette rejects," for example, might include cigarettes rejected at a cigarette rod making machine, cigarettes rejected at a filter tipping machine, cigarettes discarded at the start or end of a production run or when a machine goes down, and cigarettes from rejected pack or cartons.

An apparatus for collecting and transporting cigarette rejects in a cigarette manufacturing process comprises means for directing the rejects into a fluid stream whereby such rejects may be transported, means for transporting the rejects in the fluid stream to a predetermined location in the cigarette manufacturing process and means for separating the rejects from the fluid stream. In a further embodiment, the means for directing the rejects into a fluid stream comprise a receptacle having two end walls and two side walls. The lower portions of the end walls and side walls form an insertion opening and the upper portions of the end walls and side walls form a receiving opening. The means for transporting the cigarette rejects may comprise a conduit having a first end and a second end with a blower at the first end of the conduit and a vacuum generator at the second end of the conduit. The predetermined location in the cigarette manufacturing process may be a cigarette opener and tobacco removal unit.

In another embodiment, the means for directing the rejects into a fluid stream comprise a funneling tray, a trough comprising at least two segments and having a first end and a second end, and a first driver attached to a first trough segment. The trough is preferably V-shaped. In a preferred embodiment, the second trough segment includes a first section and a second section with a second driver attached to a second trough segment. The first trough segment is substantially horizontal and overlays the second trough segment. The first section of the second trough segment is also substantially horizontal while the second section of the second trough segment has a steeper pitch than the first section. In this embodiment, the means for transporting the rejects preferably comprises a vacuum generator positioned near the second end of the trough.

Another embodiment for an apparatus for receiving and transporting cigarette rejects in a cigarette manufacturing process comprises a receptacle having a receiving opening and an insertion opening for receiving cigarette rejects, a conduit having a first end and a second end and communicating with the insertion opening, and means for providing a fluid flow in the conduit for transporting the rejects.

In another embodiment of the present invention, an apparatus for receiving and transporting cigarette rejects in a cigarette manufacturing process may further comprise means for metering the rejects before the rejects are received in the receptacle. In one embodiment, the metering means comprise a diverter resting on the receptacle. Compressed air jets, which may be pulsed manually or automatically, may be positioned inside the receptacle above the first opening. In another embodiment, the metering means comprise a vibrating sifter, which may include a bracket, at least one spring disposed on the bracket, an upper plate resting on the at least one spring, and a vibrator attached to the upper plate.

A still further embodiment of an apparatus for receiving and transporting cigarette rejects in a cigarette manufacturing process includes a funneling tray, a trough comprising at least two segments and having a first end and a second end, a first driver attached to a first trough segment, and a vacuum generator positioned near the second end of the trough. The funneling tray guides the cigarette rejects into the trough. The first driver vibrates the first trough segment to mechanically convey the cigarette rejects toward the vacuum generator and the vacuum generator transports the cigarette rejects to a predetermined location in the cigarette manufacturing process.

The present invention also relates to a method of collecting and transporting cigarette rejects in a cigarette manufacturing process. A method of the present invention comprises directing the rejects into a fluid stream whereby such rejects may be transported, transporting the rejects in the fluid stream to a predetermined location in the cigarette manufacturing process, and separating the rejects from the fluid stream. In directing the rejects into a fluid stream, the rejects are received from the manufacturing process, the rejects are conveyed toward an insertion opening and the rejects are introduced to the fluid stream through the insertion opening. The predetermined location in the cigarette manufacturing process is preferably a cigarette opener and tobacco removal unit.

In a further embodiment of a method of the present invention, directing the rejects further comprises metering the rejects from the manufacturing process. In one embodiment, the rejects are metered by a diverter and compressed air jets positioned inside the receptacle above the insertion opening. In another embodiment, the rejects are metered by a vibrating sifter. A vibrating sifter may comprise a bracket, at least one spring disposed on the bracket, an upper plate having at least one plate opening resting on the at least one spring, and a vibrator attached to the upper plate.

In another embodiment of a method of collecting and transporting cigarette rejects in a cigarette manufacturing process, the cigarette rejects are directed into a fluid stream to be transported, the cigarette rejects are transported in the fluid stream to a predetermined location in the cigarette manufacturing process, and the cigarette rejects are separated from the fluid stream. In a one embodiment, the cigarette rejects are directed into the fluid stream by receiving the rejects from the manufacturing process, guiding the rejects into a trough, and conveying the rejects towards a vacuum generator to introduce the rejects to the fluid stream.

Figure 2:
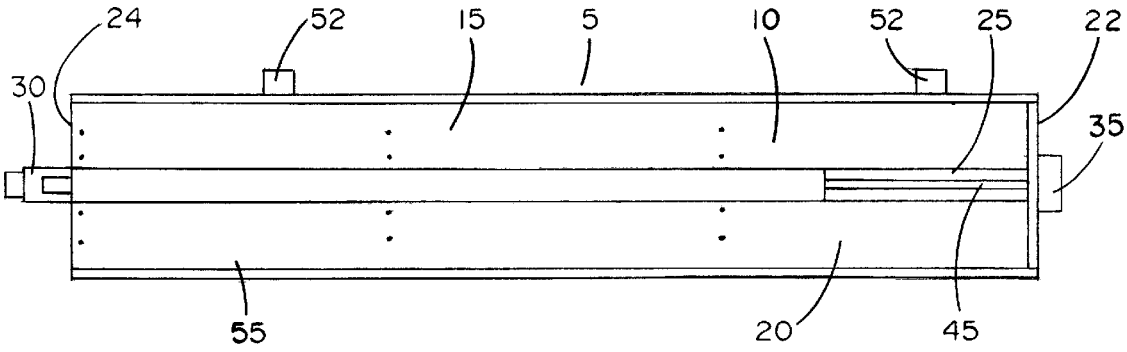
FIG. 2 is a top view of an apparatus according to the present invention.

Referring now to the drawings, FIG. 1 is a perspective view of an apparatus 5 of an embodiment of the present invention comprising a receptacle 10 converging to an insertion opening 27 above a conduit 25. The receptacle includes a first end wall 24, a second end wall 22, a first side wall 15 and a second side wall 20. The upper portions of the end walls 22,24 and side walls 15,20 form a receiving opening 29. The lower portions of the end walls 22,24 and side walls 15,20 form the insertion opening 27. While other cross-sectional shapes may be employed (e.g., a square cross-section), the conduit 25 is preferably a tube, having a circular cross-section, but is not a complete cylinder since the insertion opening 27 extends the length of the conduit 25. A fixed blower nozzle 30 is positioned on the first end wall 24 and is proximate the conduit 25, such that when a blower is attached and air is the fluid stream, air flows through the fixed blower nozzle 30 and into the conduit 25. As seen in FIG. 2, a connector 35 is positioned on second end wall 22 and is proximate the conduit 25, such that a vacuum generator can be connected with a hose to receive cigarette rejects from the apparatus and transport them to another apparatus in a cigarette manufacturing process for further processing. In a preferred embodiment, the cigarette rejects are transported to a cigarette opener and tobacco removal unit. The receptacle 10 and conduit 25 are mounted on a frame 52 with four casters 50 (only two of which are visible in FIG. 1) to assist in movement of the apparatus.

A fluid divider 40 divides the conduit 25 into two passages (top and bottom). As shown in FIG. 1, the fluid divider 40 is a horizontally-aligned member. The fluid divider may have other cross-sections, such as being U-shaped as shown in FIGS. 10–16. The fluid divider 40 is connected to the fixed blower nozzle 30 and effectively divides the blowing air stream into two flow streams in order to ensure blowing air through the length of the conduit 25. Depending on the diameter of the conduit 25 or the amount of cigarette rejects entering the receptacle, a fluid divider may not be necessary.

Figure 9:
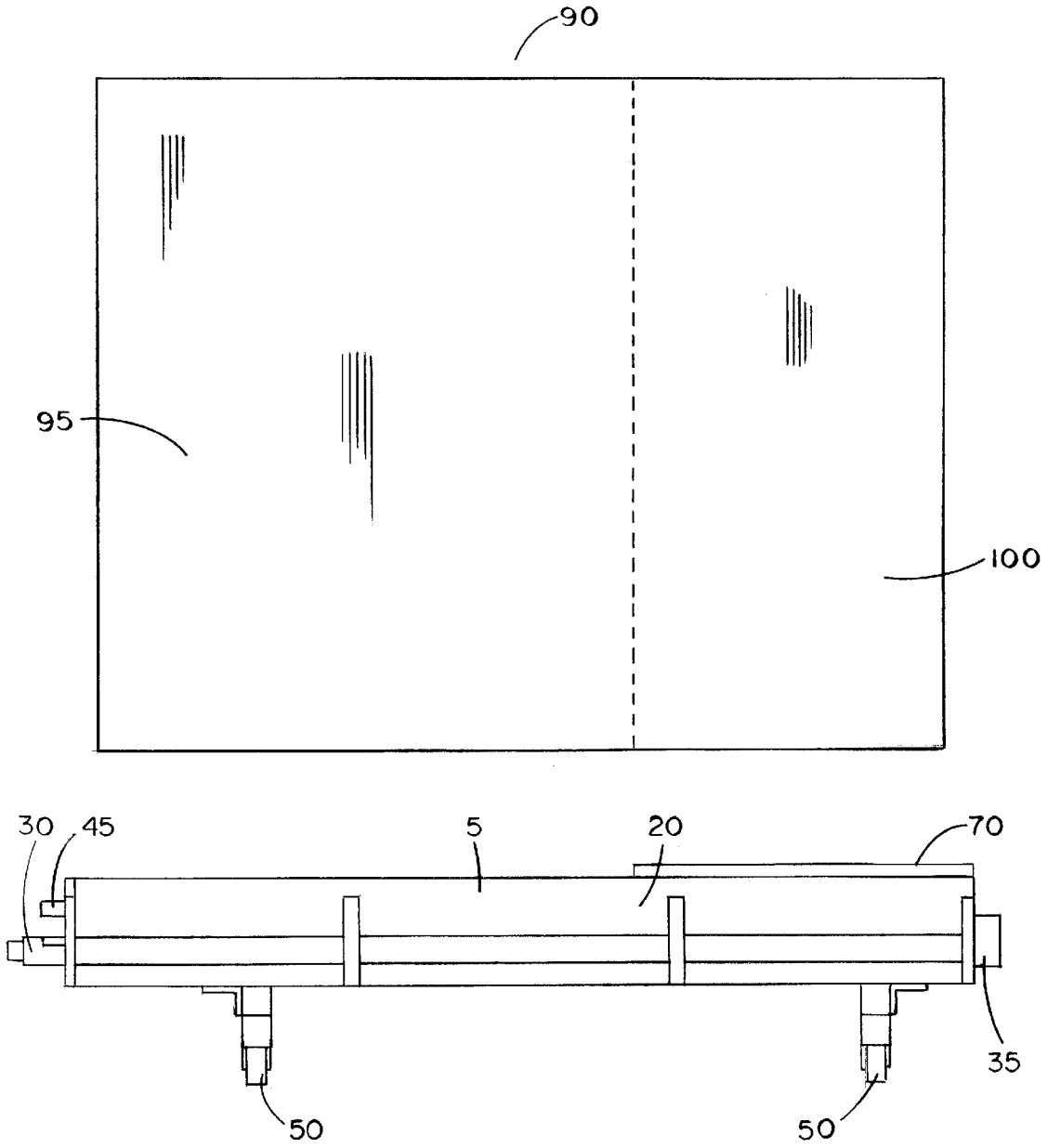
FIG. 9 is a side view of an embodiment of an apparatus according to the present invention showing one location within a cigarette manufacturing process.

In a preferred embodiment, the fluid divider 40 does not extend through the entire length of the tube. For example in an embodiment of the present invention where the apparatus is positioned below a MAX 80 filter tipping machine (e.g., as shown in FIG. 9), the fluid divider preferably extends approximately one half of the length of the conduit. As noted below with regard to FIG. 9, a MAX 80 filter tipping machine has an assembly section and an inspection section. The inspection section refers generally to the location where finished cigarettes are tested. Waste from the inspection section discharges from the bottom of the machine and is typically rejected cigarettes. A fluid divider is preferably connected to the fixed blower nozzle and extends through the portion of the conduit that is positioned below the inspection section of the filter tipping machine. The fluid divider ensures that at least some of the fluid (e.g., air) passing through the conduit is undisturbed or uninterrupted by cigarette rejects as they fall from the filter tipping machine.

The other section of the filter tipping machine, the assembly section, involves attaching filters to the tobacco rods. Waste from the assembly section (e.g., filter materials and filter paper) discharges out the bottom of the machine. Most of the waste from the assembly section is filter and paper waste that is to be discarded whether recovered below the filter tipping machine or at a tobacco removal unit. Thus, as set forth below with regard to FIG. 8, a waste pan 70 is preferably positioned on the apparatus below the assembly section to collect the filter and paper waste.

Figure 7:
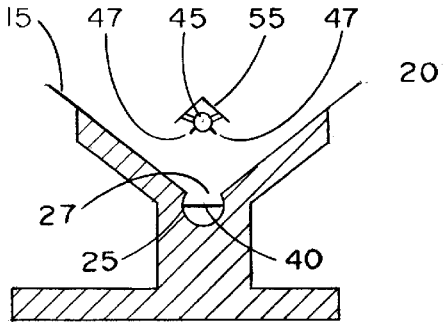
FIG. 7 is a cross-sectional view of the apparatus shown in FIG. 6 taken along the line 7—7.

FIGS. 1 and 7 show means for metering the cigarette rejects. The embodiment in FIG. 1 shows an air jet tube 45. The air jet tube 45 is provided with a plurality of compressed-air jets 47 along its length. The compressed-air jets 47 are used to facilitate material removal when the flow of materials into the conveyor is higher than normal. For example, in a cigarette production process, at the beginning of a production run, the reject rates of cigarettes are high and the compressed-air jets 47 facilitate removal of the rejects. These jets 47 are pulsed automatically through the use of a programmable logic controller (PLC). The compressed-air jets 47 may also be actuated by a machine operator using a manual push-button. A diverter 55 is also shown in FIG. 1. The diverter 55 serves to divide, align and meter the rejected cigarettes as they fall from the inspection section 95 to prevent them from clogging the insertion opening when reject loads are excessive. The diverter 55 also helps the conveyor take away rejected cigarette materials during start-up or shutdown when many cigarettes are rejected at once.

With regard to the construction of the apparatus, the conduit 25, the receptacle 10 (including end walls 22, 24 and side walls 15, 20), the fluid divider 40 and the diverter 55 are preferably constructed from stainless steel. Because the frame 52 does not contact cigarettes or tobacco and is mainly used for support, it is preferably constructed from extruded aluminum. The casters 50 are preferably constructed from polyolefin. The dimensions of the apparatus 5 vary depending upon the specific machine below which it is placed and the materials to be conveyed. For example, a preferred embodiment of the apparatus to be positioned below a MAX 80 filter tipping machine (commercially available from Hauni-Werke & Korber Co. KG) has the following dimensions. The conduit 25 is preferably 71 inches (1800 mm) long and 4.0 inches (in.) in diameter. The apparatus 5 also effectively operates with a conduit 25 that is 3.0 inches in diameter. The diameter of the conduit 25 depends on several factors, including: the quantity of cigarettes and cigarette rejects being transported; the length of the cigarettes and cigarette rejects being transported; the size of the vacuum generator; and the amount of compressed air available.

The insertion opening 27 along most of the length of the top side of the conduit 25 is preferably 24 mm wide. The two side walls 15, 20 that flank the length of the insertion opening 27 preferably rise angularly and equally from the insertion opening 27, preferably at an included angle of 110 degrees. The preferred distance between the tops of the side walls 15, 20 (i.e., the width of the receiving opening) is 300 mm. While the above dimensions represent a preferred embodiment of an apparatus for receiving and transporting cigarette rejects in a cigarette manufacturing process for use below a MAX 80 filter tipping machine, persons of ordinary skill in the art can readily construct an apparatus to suit their needs based on the description herein. In addition, apparatuses having different dimensions can also operate effectively beneath a MAX 80 filter tipping machine.

Figure 3:
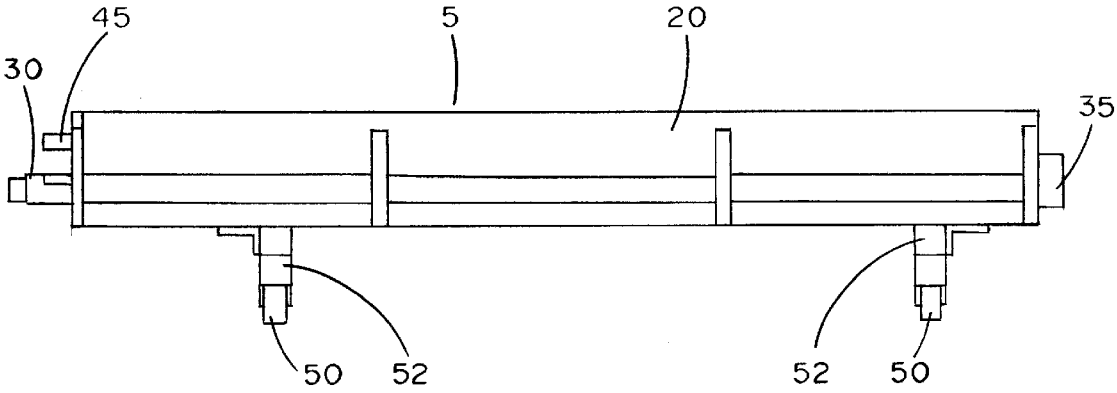
FIG. 3 is a side view of an apparatus according to the present invention.
Figure 4:
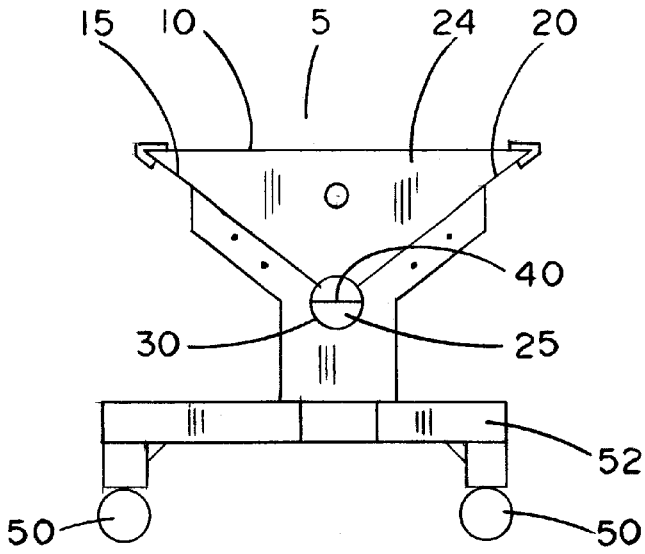
FIG. 4 is an end view of a first end of an apparatus according to the present invention.

FIG. 2 is a top view of an apparatus 5 of an embodiment of the present invention and FIG. 3 is a side view, showing the same features discussed with regard to FIG. 1. FIG. 4 is an end view of an embodiment of an apparatus 5, showing the same features discussed with regard to FIG. 1.

Figure 5:
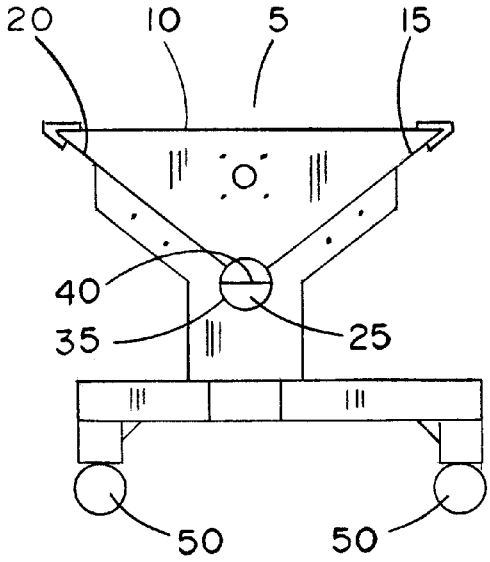
FIG. 5 is an end view of a second end of an apparatus according to the present invention.

The end shown in FIG. 4 is the end to which a blower may be attached as shown by fixed blower nozzle 30. FIG. 5 is an end view of the opposite end of an embodiment of the apparatus 5. The end shown in FIG. 5 is the end to which a hose and vacuum generator may be attached.

Figure 6:
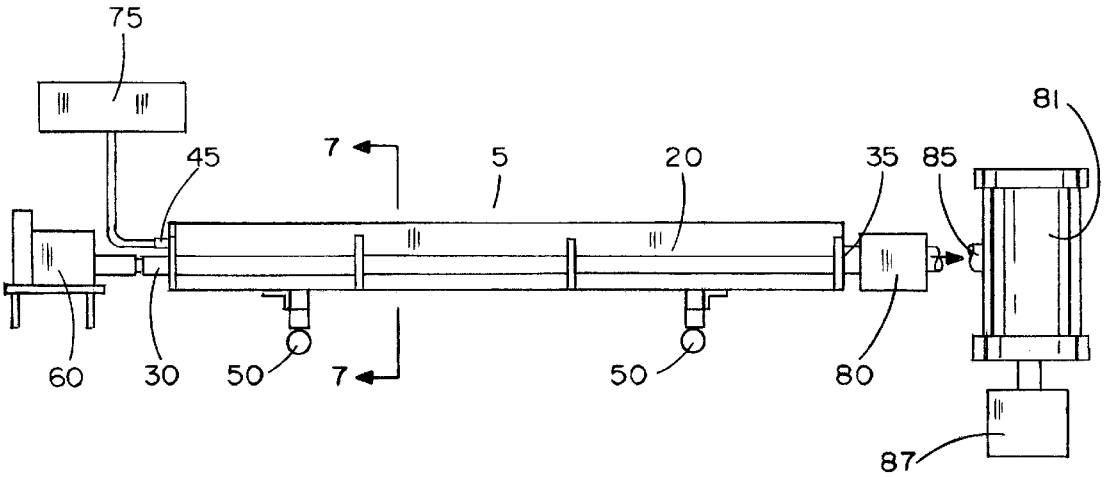
FIG. 6 is a side view of another embodiment of an apparatus according to the present invention.

FIG. 6 is a side view of an embodiment of an apparatus 5 according to the present invention. A blower 60 is attached to the fixed blower nozzle 30. Preferably, the blower 60 and the fixed blower nozzle 30 are designed such that the blower 60 may be quickly and easily disconnected from the fixed blower nozzle 30. The blower 60 is preferably a fan-type blower with a filter attached to it. With a receptacle 10 and conduit 25 having the dimensions set forth above for use beneath a MAX 80 filter tipping machine, the blower 60 preferably provides sufficient air to efficiently move the cigarette rejects to the predetermined location in the cigarette manufacturing process. For example, in an embodiment for use beneath a MAX 80 filter tipping machine, the blower may provide air moving through the conduit 25 at approximately 100–125 cubic feet per minute. A person of ordinary skill in the art could readily adjust the air pressure depending on the dimensions of the conduit and on the size of the cigarette rejects (e.g., length, diameter, etc.) to effectively transport cigarette rejects using a single apparatus.

In another embodiment of the present invention, a blower is not required. For example, in a cigarette manufacturing process, "factory air" is generally available. The factory air is a large positive air stream produced on site and is available at various stages of the cigarette manufacturing process. Factory air is typically supplied from a central location, having a large number of compressors, in the factory. An apparatus of the present invention may be run using factory air. A person of ordinary skill in the art could readily construct an apparatus of the present invention with the appropriate dimensions based on the pressure of the factory air available.

The apparatus shown in FIG. 6 includes a vacuum generator 80 connected to the conduit 25, opposite the end where the blower 60 is connected. The vacuum generator 80 is connected to the conduit 25 by a connector 35. A hose 85 is connected to the vacuum generator 80. The vacuum generator 80 is preferably a compressed-air driven vacuum generator made only of aluminum and steel. The hose 85 is preferably constructed from nylon. When materials fall through the insertion opening 27 and into the conduit 25, the blower 60 forces them to the other end of the conduit. The cigarette rejects are then drawn into the vacuum generator 80 and accelerated into the hose 85 where they are transported to a separator 86, which separates the rejects from the fluid stream for further processing. An example of a separator for use in the present invention is discussed in greater detail with regard to FIGS. 17 and 18.

As shown in FIG. 6, the cigarette rejects leave the separator 86 and enter a cigarette opener and tobacco removal unit 87. The directional arrow shown in FIG. 6 simply indicates the directional flow of the air and any items entrained therein (e.g., cigarette rejects).

Figure 17:
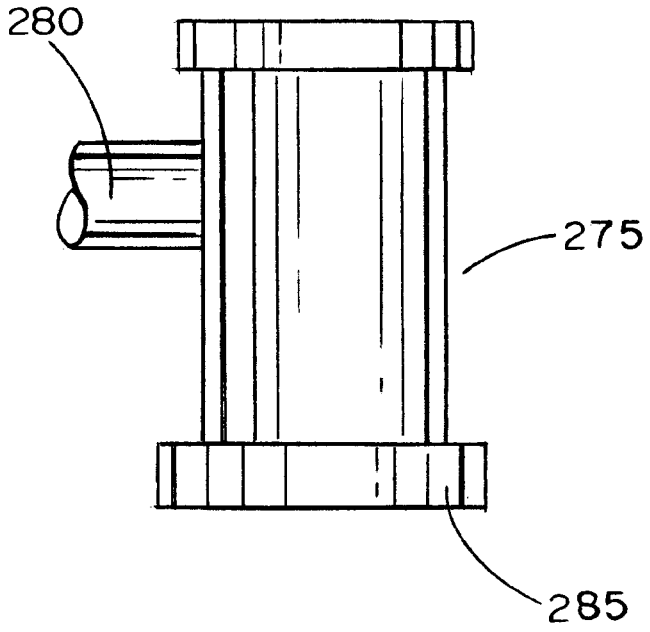
FIG. 17 is a side view of a separator as used in the present invention.
Figure 18:
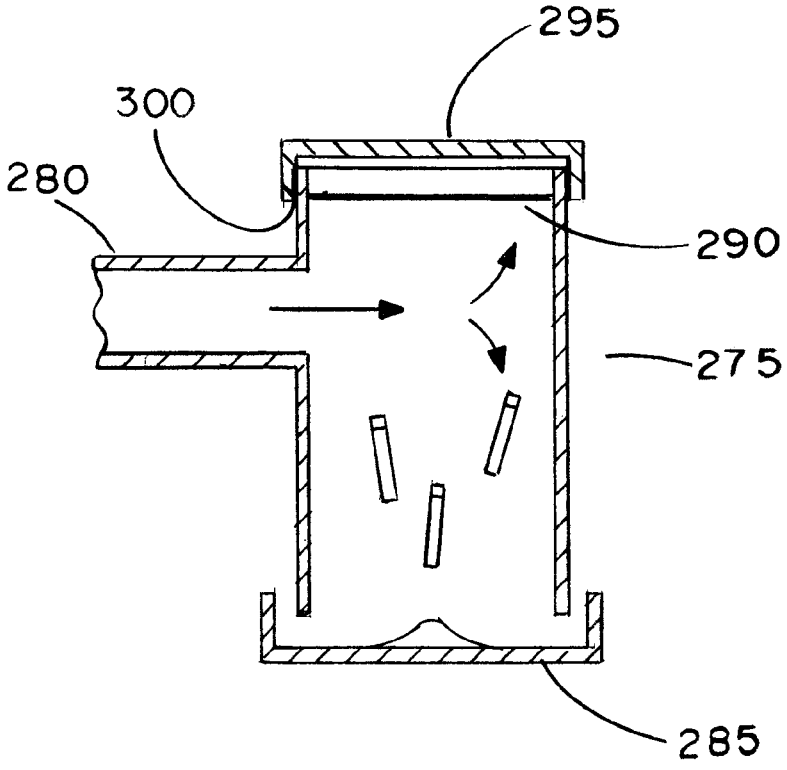
FIG. 18 is a cross-sectional view of a separator as used in the present invention.

As seen in FIGS. 1–6, the receptacle is designed to receive and direct the cigarette rejects through the insertion opening into a fluid stream in the conduit. The fluid may be any fluid which may effectively transport the cigarette rejects. In a preferred embodiment, the fluid stream is air. When the fluid stream is air, it is preferably generated by a blower and a vacuum generator. When the cigarette rejects reach the fluid stream, the rejects are transported to a predetermined location in the cigarette manufacturing process, such as a cigarette opener and tobacco removal unit. At this predetermined location, the cigarette rejects are preferably separated from the fluid stream. In a preferred embodiment, the cigarette rejects are separated from the fluid stream by a separator as shown in FIGS. 17–18.

The cigarette rejects are transported in the fluid stream leaving an apparatus of the present invention (as shown in FIG. 6) through the hose 85 to the separator. When the fluid stream and cigarette rejects enter the separator, the velocity of the fluid stream decreases as a result of leaving the hose, causing the cigarette rejects to fall out of the fluid stream. In a preferred embodiment, the cigarette rejects fall into a feed bowl for a cigarette opener and tobacco removal unit.

FIG. 6 further shows means for metering the cigarette rejects. The metering means shown include a compressed air source 75 connected to the air jet tube 45. The compressed air source 75 provides air to the air jet tube 45, having a plurality of air jet openings 47 along its length. The air jet openings 47 facilitate the movement of materials from the receptacle 10, through the insertion opening 27 and into the conduit 25 during times of high volume, such as the start of a new production run. The air jets also separate any clusters of cigarettes trapped between the diverter 55 and the side walls 15,20 of the receptacle 10. The air jets may be pulsed automatically by a PLC or manually by a machine operator. The air jets may be automatically activated at start-up of the filter tipping machine when most rejects occur.

FIG. 7 is a cross-sectional view of an embodiment of the apparatus shown in FIGS. 1–6 and taken along the line 7—7 of FIG. 6. FIG. 7 shows the conduit 25, the insertion opening 27 and the fluid divider 40 in the conduit 25. Side walls 15 and 20 form part of the receptacle and a person of ordinary skill in the art can readily see how the receptacle guides materials through the insertion opening 27 and into the conduit 25. The means for metering cigarette rejects are also shown in FIG. 7 with the diverter 55 and the air jet tube 45. The air jet tube 45 is shown having a plurality of air jet openings 47, which, as shown, are pointed generally toward the side walls 15, 20. When a large number of cigarette rejects enter the receptacle at one time, the plurality of air jet openings 47 may be actuated to prevent the insertion opening 27 from becoming clogged by blowing air at the side walls and providing separation to the incoming cigarette rejects. The plurality of air jet openings 47 also separate any clusters of cigarettes trapped between the diverter 55 and the side walls 15,20 of the receptacle 10.

Figure 8:
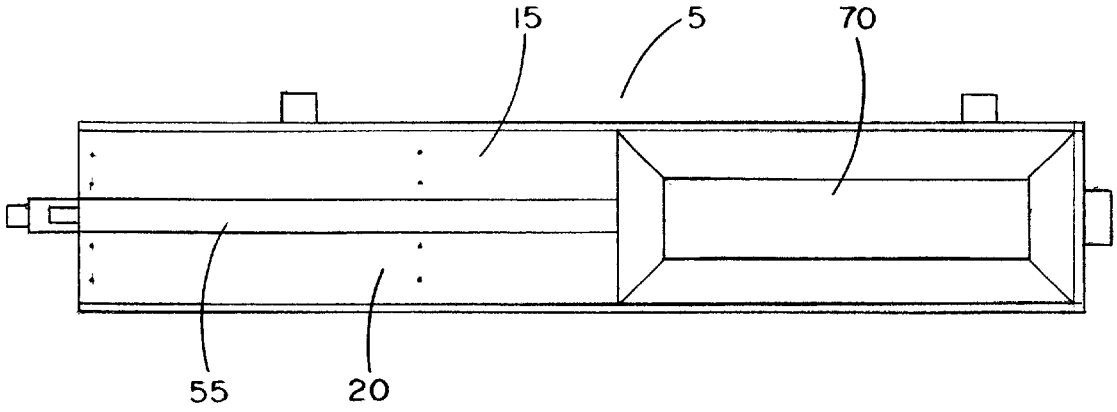
FIG. 8 is a top view of another embodiment of an apparatus according to the present invention.

FIG. 8 is a top view of another embodiment of an apparatus 5 of the present invention. FIG. 8 shows the diverter 55 and a waste pan 70. The waste pan 70 rests on top of the receptacle's side walls 15,20. When the apparatus 5 is positioned below a filter tipping machine, such as a MAX 80, the waste pan 70 prevents filters and roll-block jam waste from getting into the apparatus 5. As shown in FIG. 8, the waste pan preferably has a solid metal bottom. In another embodiment, the waste pan has an expanded metal bottom similar to a grate.

FIG. 9 is a side view of an embodiment of the apparatus 5 for use in a cigarette production process positioned below a filter tipping machine 90. A MAX 80 filter tipping machine will be discussed herein for illustrative purposes. The filter tipping machine 90 as shown is divided into two sections, the inspection section 95 and the assembly section 100. Actual filter tipping machines do not have a physical division into two sections. The assembly section 100 of the filter tipping machine 90 involves attaching filters to the tobacco rods. In the assembly section 100, long sections of filters are cut before being attached to the tobacco rods. Waste from the assembly section 100 (e.g., filter materials and filter paper) discharges out the bottom of the machine. Most of the waste from the assembly section 100 is filter and paper waste. Because the filter and paper waste is to be discarded whether recovered below the filter tipping machine or at the tobacco removal unit, a waste pan 70, as described above with regard to FIG. 8, is preferably positioned on the apparatus 5 below the assembly section 100 to collect the filter and paper waste. The waste pan 70 is particularly useful in preventing the apparatus from becoming clogged at the beginning of new production runs when the amount of filter and paper waste discharged from the assembly section 100 of the filter tipping machine 90 is high.

The other section of the filter tipping machine, the inspection section 95, refers generally to the location where finished cigarettes are tested. Waste from the inspection section 95 also discharges from the bottom of the machine and is typically rejected cigarettes. A diverter 55, although not shown in FIG. 9, is preferably below the inspection section 95 of the filter tipping machine 90. The diverter 55 serves to divide, align and meter the rejected cigarettes as they fall from the inspection section 95 to prevent them from clogging the insertion opening. Also, as shown in FIG. 6, a plurality of air jet openings along the length of the air jet tube 45 separate any cluster of cigarettes trapped between the diverter 55 and the side walls. 15,20.

Figure 10:
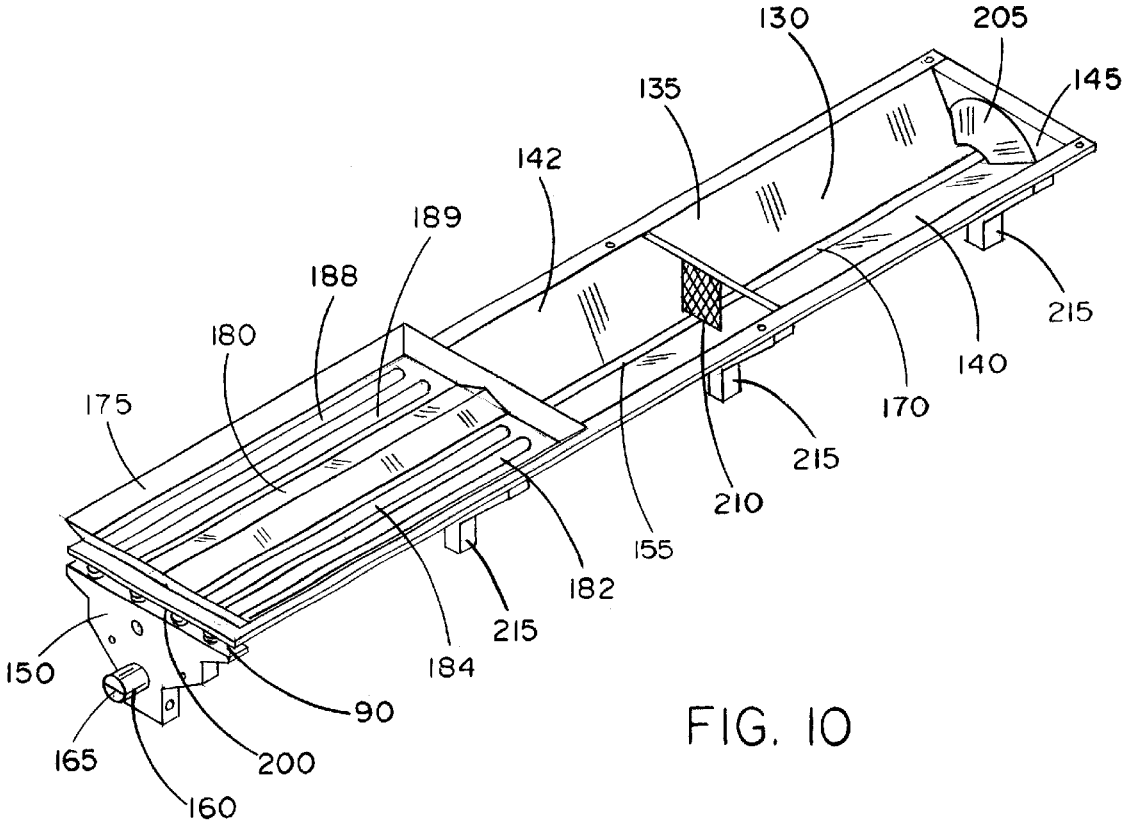
FIG. 10 is a perspective view of another embodiment of an apparatus of the present invention.

FIGS. 10–16 illustrate another embodiment of an apparatus of the present invention. FIG. 10 is a perspective view of another embodiment of an apparatus 125 of the present invention comprising a receptacle 130 converging to an insertion opening 170. The insertion opening 170 allows cigarette rejects to enter a conduit 155. The receptacle includes a first end wall 150, a second end wall 145, a first side wall 135 and a second side wall 140. The upper portions of the end walls 145,150 and side walls 135,140 form a receiving opening 142. The lower portions of the end walls 145,150 and side walls 135,140 form the insertion opening 170. While other cross-sectional shapes may be employed, the conduit 155 is preferably a tube, having a circular crosssection, but is not a complete cylinder since the insertion opening 170 extends the length of the 20 conduit 155.

Figure 11:
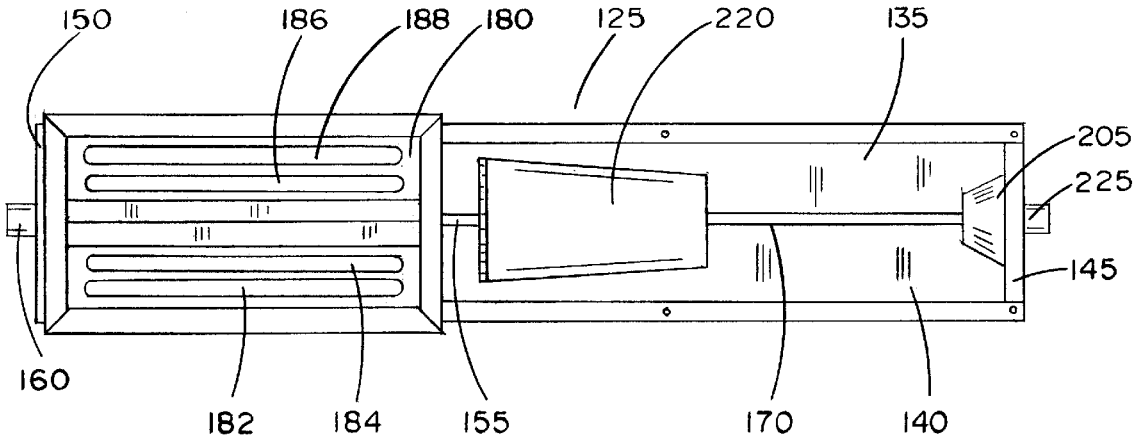
FIG. 11 is a top view of another embodiment of an apparatus according to the present invention.

A fixed blower nozzle 160 is positioned on the first end wall 150 and is proximate the conduit 155, such that when a blower is attached and air is the fluid stream, air flows through the fixed blower nozzle 160 and into the conduit 155. As seen in FIG. 11, a connector 225 is positioned on second end wall 145 and is proximate the conduit 155, such that a vacuum generator can be connected with a hose to receive cigarette rejects from the apparatus and transport them to another apparatus in a cigarette manufacturing process for further processing. In a preferred embodiment, the cigarette rejects are transported to a cigarette opener and tobacco removal unit. The receptacle 130 and conduit 155 are mounted on a frame 215. The frame is preferably placed on casters to assist in movement of the apparatus.

Figure 13:
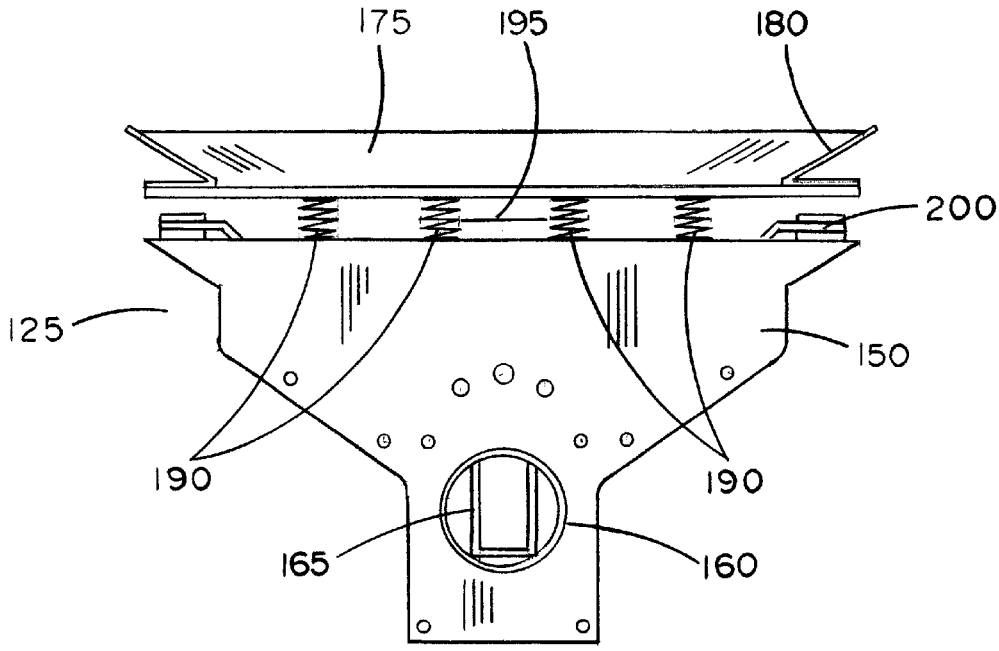
FIG. 13 is a side view of a first end of another embodiment of an apparatus according to the present invention.

A fluid divider 165 divides the conduit 155 into two passages. As shown in FIGS. 10 and 13, the U-shaped fluid divider 165 is connected to the fixed blower nozzle 160 and effectively divides the blowing air stream in order to ensure fluid flow at both ends of the apparatus 125, even if one end is clogged for some reason. The U-shaped fluid divider 165 is effective in handling longer cigarettes (e.g., 100 mm) as it permits the cigarette rejects to fall to a greater depth in the conduit, which results in a more efficient transportation of longer cigarettes. By falling to a greater depth, any tendency of the cigarette rejects to float out of the conduit is reduced. Depending on the diameter of the conduit 155 or the amount of cigarette rejects entering the receptacle, a fluid divider may not be necessary.

In a preferred embodiment, the fluid divider 165 does not extend through the entire length of the tube. For example in an embodiment of the present invention where the apparatus is positioned below a MAX 80 filter tipping machine (e.g., as shown in FIG. 6), the fluid divider preferably extends approximately one half of the length of the conduit. The fluid divider is preferably connected to the fixed blower nozzle and extends through the portion of the conduit that is positioned below the inspection section of the filter tipping machine. The fluid divider ensures that at least some of the fluid (e.g., air) passing through the conduit is undisturbed or uninterrupted by cigarette rejects as they fall from the filter tipping machine.

The embodiment shown in FIG. 10 also shows means for metering the cigarette rejects. The metering means are particularly useful at times when the cigarette reject rate from a machine is high (e.g., during the start-up of a filter tipping machine) as the metering means control the rate at which the cigarette rejects enter the fluid stream and aligns the cigarettes in the direction of fluid flow to prevent the conduit from becoming clogged. The metering means of FIG. 10 comprise a vibrating sifter 175. The vibrating sifter 175 includes a bracket 200, at least one spring 190 disposed on the bracket, an upper plate 180 resting on the at least one spring, and a vibrator (not visible in FIG. 10) attached to the upper plate. The upper plate 180 has plate openings 182, 184,186,188, which meter the cigarette rejects as they fall into the receptacle 130. While four plate openings 182, 184, 186, 188 are shown in FIG. 10, the upper plate 180 may include any number of plate openings. In addition, the width of the plate openings may vary. In the embodiment shown in FIG. 10, having four plate openings, the plate openings 182, 184, 186, 188 are preferably one inch wide. The upper plate is preferably constructed from stainless steel and may be machined or stamped.

The upper plate 180 rests on at least one spring 190. In a preferred embodiment, springs 190 are located at each end of the upper plate 180. In the embodiment shown, four springs 190 are shown at one end of the upper plate (near one end 150 of the apparatus 125). Four other springs, which are not visible in FIG. 10, are located at the other end of the upper plate 180. The number of springs used may be varied. For example, in another embodiment, two springs may be located at each end of the upper plate.

The springs 190 are disposed on bracket 200. The bracket 200 is preferably rigid, such that the oscillations of the springs result in the movement of the upper plate 180. A vibrator 195 (shown in FIGS. 12–13, 16) is attached to the upper plate 180 and normally located below the upper plate 180. When the vibrator 195 is operating, it moves the upper plate 180 (as the upper plate rests on springs), which assists in metering the cigarette rejects. The movement of the upper plate 180 by virtue of the vibrator 195 and the springs 190 prevents the plate openings 182, 184, 186, 188 from becoming clogged with cigarette rejects.

FIG. 10 also illustrates other variations of an embodiment of an apparatus of the present invention. These variations assist in keeping the cigarette rejects in the fluid stream once the cigarette rejects enter the conduit 155. A compound funnel 205 is shown inside the receptacle 130 near the end of the receptacle 145 to which a vacuum generator may be attached. The compound funnel 205 is sloped on both its upper surface and lower surface. The distance between the lower surface of the compound funnel 205 and the insertion opening 170 decreases from the end of the compound funnel 205 that is open to the receptacle 130 to the end of the funnel that is proximate the end wall 145 of the receptacle. In other words, the lower surface of the compound funnel 205 is sloped to direct the cigarette rejects back into the conduit 155 if the rejects lift out of the fluid stream. The upper surface of the compound funnel 205 is also sloped as shown in FIG. 10 to direct cigarette rejects that escape the fluid stream back into the insertion opening 170.

Another feature shown in FIG. 10 is a doffer member 210. The doffer member 210 is shown extending over the receptacle 130. The doffer member 210 preferably extends downwardly into the receptacle just above the insertion opening 170. The doffer member, along with the hinged flap 220 shown in FIG. 11, prevent cigarette rejects from rising out of the conduit 155. If cigarette rejects which are being transported through the conduit 155 in a fluid stream begin to rise out of the conduit 155, they hit the doffer member 210 and are knocked back into the conduit 155.

FIG. 11 is a top view of an embodiment of an apparatus 125 of the present invention showing the same features discussed with regard to FIG. 10. Instead of the doffer member 210 shown in FIG. 10, the embodiment in FIG. 11 utilizes a hinged flap 220 to prevent cigarette rejects from flying out of the fluid stream. The hinged flap 220 is preferably constructed from stainless steel or aluminum. While the flap is preferably hinged, it may also be fixed to the receptacle 130. In a preferred embodiment, an apparatus of the present invention includes both a hinged flap and a doffer member. FIG. 11 also shows the connector 225 to which a vacuum generator may be attached.

Figure 12:
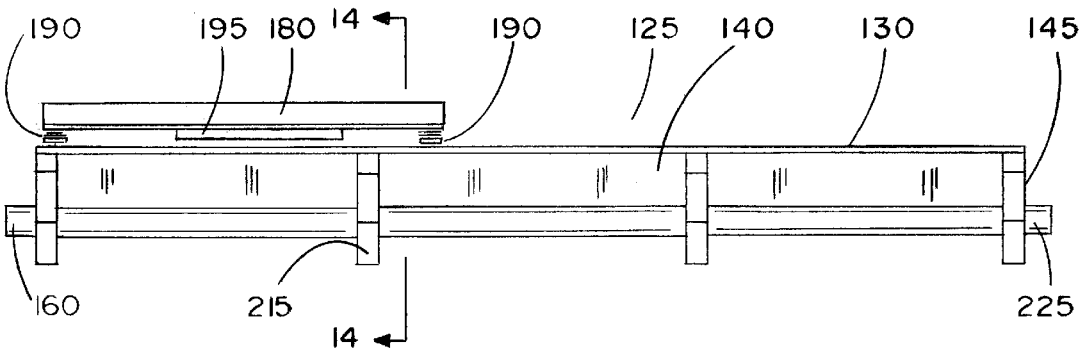
FIG. 12 is a side view of another embodiment of an apparatus according to the present invention.

FIG. 12 is a side view, showing the same features discussed with regard to FIG. 10. FIG. 13 is an end view of the apparatus 125 shown in FIG. 10. The end shown in FIG. 13 is the end to which a blower would attach if air were the fluid stream as shown by fixed blower nozzle 160. FIG. 13 provides a better view of the components of the vibrating sifter 175, particularly the springs 190, the vibrator 195 and the bracket 200. FIG. 13 also provides a better view of the U-shaped fluid divider 165.

Figure 14:
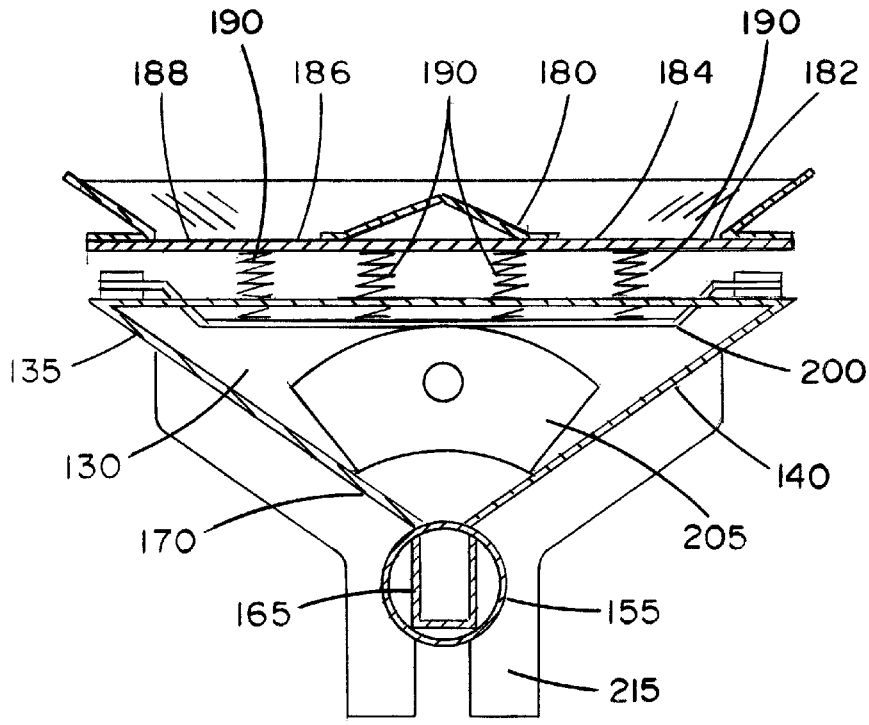
FIG. 14 is a cross-sectional view of the apparatus shown in FIG. 12 taken along the line 14—14.

FIG. 14 is a cross-sectional view of an embodiment of the apparatus shown in FIGS. 10–13 (without the doffer member 210 and hinged flap 220) and taken along the line 14—14 of FIG. 12. FIG. 14 shows the conduit 155, the insertion opening 170 and the U-shaped fluid divider 165 in the conduit 155. Side walls 135 and 140 form part of the receptacle and a person of ordinary skill in the art can readily see how the receptacle guides cigarette rejects through the insertion opening 170 and into the conduit 155. FIG. 14 also shows the other end of the vibrating sifter 175 (the end not shown in FIG. 13), including the upper plate 180 (with plate openings 182,184,186,188), the four springs 190 and the bracket 200. Compound funnel 205 is also shown and it is readily apparent how it prevents cigarette rejects from exiting the conduit 155 near the end of the receptacle 130.

Figure 15:
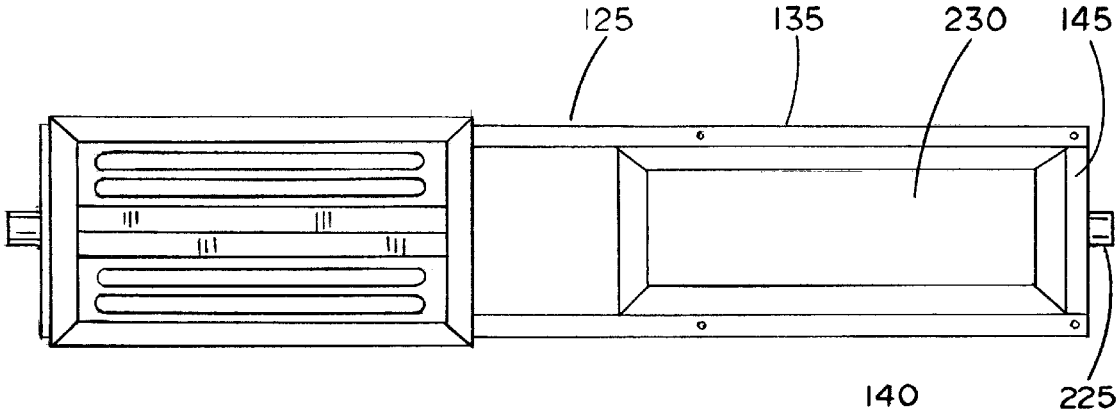
FIG. 15 is a top view of another embodiment of an apparatus according to the present invention.

FIG. 15 is a top view of another embodiment of an apparatus 125 of the present invention. FIG. 15 shows a waste pan 230, which is preferably included in all embodiments of the present invention. As noted above with regard to FIG. 8, the waste pan 230 rests on top of the receptacle's side walls 135, 140. When the apparatus 125 is positioned below a filter tipping machine, such as a MAX 80, the waste pan 230 prevents filters and roll-block jam waste from getting into the apparatus 125 while allowing for air flow in and around the waste pan 230. The waste pan 230 preferably has a solid metal bottom. In another embodiment, the waste pan has an expanded metal bottom similar to a grate.

Figure 16:
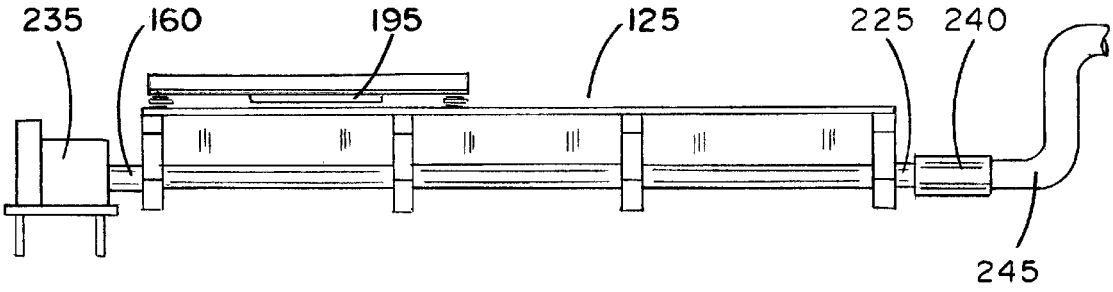
FIG. 16 is a side view of another embodiment of an apparatus according to the present invention.

FIG. 16 is a side view of another embodiment of an apparatus according to the present invention. In the embodiment shown in FIG. 16, the fluid stream in the conduit 155 is air. The fluid stream is generated by a blower 235 and a vacuum generator 240. The blower 235 is attached to the fixed blower nozzle 160. Preferably, the blower 235 and the fixed blower nozzle 160 are designed such that the blower 235 may be quickly and easily disconnected from the fixed blower nozzle 160. The blower 235 is preferably a fan-type blower with a filter attached to it. With a receptacle 130 and conduit 155 for use beneath a MAX 80 filter tipping machine, the blower 235 preferably provides sufficient air to efficiently move the cigarette rejects to the predetermined location in the cigarette manufacturing process. For example, in an embodiment for use beneath a MAX 80 filter tipping machine, the blower may provide air moving through the conduit 155 at approximately 100–125 cubic feet per minute. A person of ordinary skill in the art could readily adjust the air pressure depending on the dimensions of the conduit and on the size of the cigarette rejects (e.g., length, diameter, etc.) to effectively transport cigarette rejects using a single apparatus.

In another embodiment of the present invention, a blower is not required. For example, in a cigarette manufacturing process, "factory air" is generally available. The factory air is produced on site and is available at various stages of the cigarette manufacturing process. An apparatus of the present invention may be run using factory air. A person of ordinary skill in the art could readily construct an apparatus of the present invention with the appropriate dimensions based on the pressure of the factory air available.

The apparatus shown in FIG. 16 includes a vacuum generator 240 connected to the conduit, opposite the end where the blower 235 is connected. The vacuum generator 240 is connected to the conduit by a connector 225. A hose 245 is connected to the vacuum generator 2400. The vacuum generator 240 is preferably a compressed-air driven vacuum generator made only of aluminum and steel. The hose 245 is preferably constructed from nylon. When cigarette rejects fall through the insertion opening and into the conduit, the blower 235 forces them to the other end of the conduit. The cigarette rejects are then sucked into the vacuum generator 240 and accelerated into the hose 245 where they are transported for further processing. In a preferred embodiment, the cigarette rejects are separated from the fluid stream by a separator as shown and described with regard to FIGS. 17–18.

As seen in FIGS. 10–16, the receptacle is designed to receive and direct the cigarette rejects through the insertion opening into a fluid stream in the conduit. The fluid may be any fluid which may effectively transport the cigarette rejects. In a preferred embodiment, the fluid stream is air. When the fluid stream is air, it is preferably generated by a blower and a vacuum generator. When the cigarette rejects reach the fluid stream, the rejects are transported to a predetermined location in the cigarette manufacturing process, such as a cigarette opener and tobacco removal unit. Just prior to reaching the predetermined location, the cigarette rejects are preferably separated from the fluid stream by a separator.

The materials used in the construction of the apparatus shown in FIGS. 10–16 and the dimensions of the apparatus are preferably the same as those discussed above with regard to FIG. 1.

FIGS. 17–18 illustrate a separator 275 as used in the present invention. The separator separates the cigarette rejects from the fluid stream. The cigarette rejects are transported in the fluid stream leaving an apparatus of the present invention (as shown in FIG. 6) through the hose 280 to the separator 275. When the fluid stream and cigarette rejects enter the separator 275, the velocity of the fluid stream decreases as a result of leaving the smaller diameter of the hose 280 and entering the larger diameter of the separator 275, causing the cigarette rejects to fall out of the fluid stream. In a preferred embodiment, the cigarette rejects fall into a feed bowl 285 for a cigarette opener and tobacco removal unit.

The separator 275 is preferably cylindrical with a diameter of approximately 300 mm although persons of ordinary skill in the art will recognize that other shapes and sizes may be used. The center of the hose 280 is preferably three-quarters of the way up the separator 275 from the bottom. A screen 290 is at the top of the separator 275 and allows the fluid stream (e.g., air) to leave the separator 275 while preventing the cigarette rejects from escaping through the top of the separator 275. A cover 295 rests on top of the separator 275 to control the flow of air out of the top of the separator 275. A gap 300 exists between the separator 275 and the cover 295, which allows air to leave the separator 275. When the separator has a diameter of 300 mm, the gap is preferably 25 mm wide.

Figure 19:
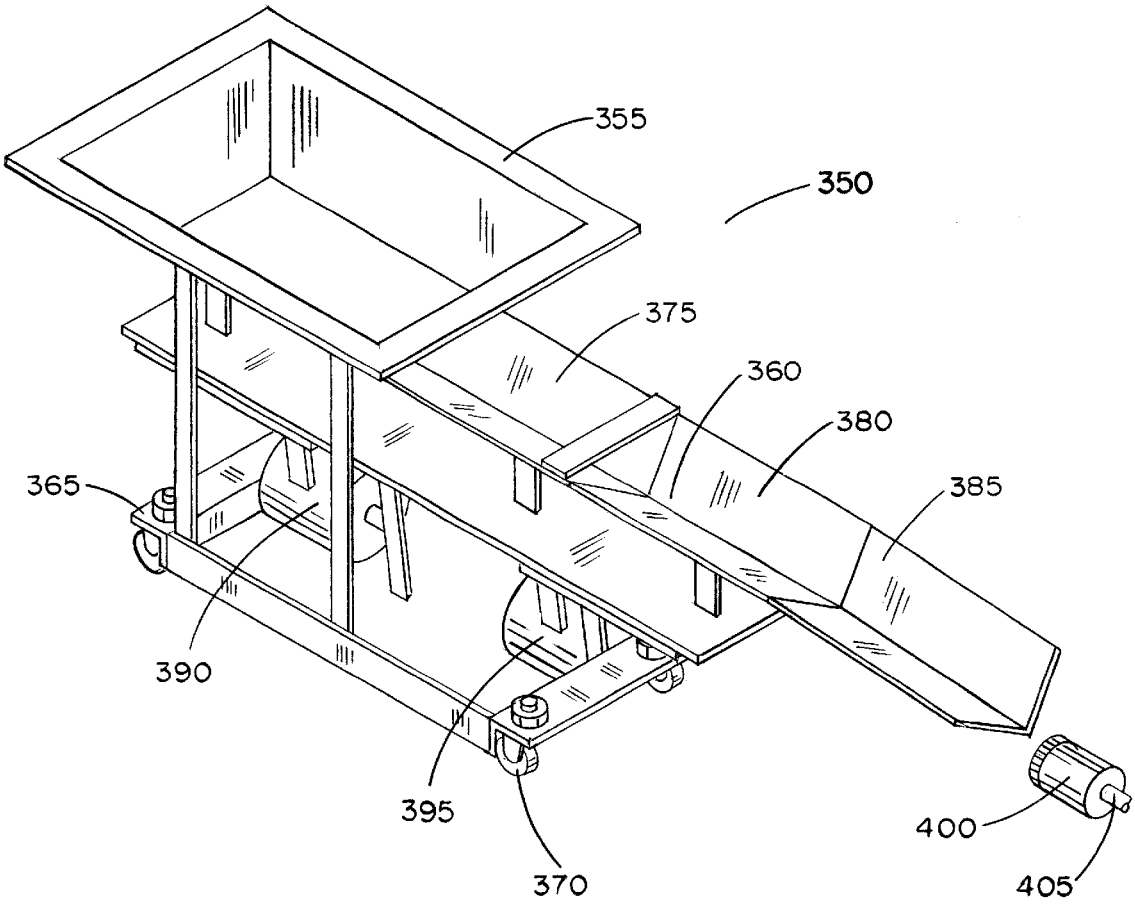
FIG. 19 is a perspective view of another embodiment of an apparatus of the present invention.

FIGS. 19–26 illustrate another embodiment of the present invention. FIG. 19 is a perspective view of an apparatus 350 of the present invention. The apparatus 350 shown includes a funneling tray 355 and a trough 360 having two ends. The trough is mounted,on a frame 365 preferably with casters 370. As shown in FIG. 19, trough 360 includes two trough segments 375,380. A first driver 390 is attached to the first trough segment 375. A second driver 395 is attached to the second trough segment 380. The second trough segment 380 includes two sections 385,387. The drivers 390,395 mechanically convey the cigarette rejects toward a vacuum generator 400. The vacuum generator 400 transports the rejects in a fluid stream (e.g., air) through a hose 405 to a predetermined location in the cigarette manufacturing process, such as a cigarette opener and tobacco removal unit.

Figure 20:
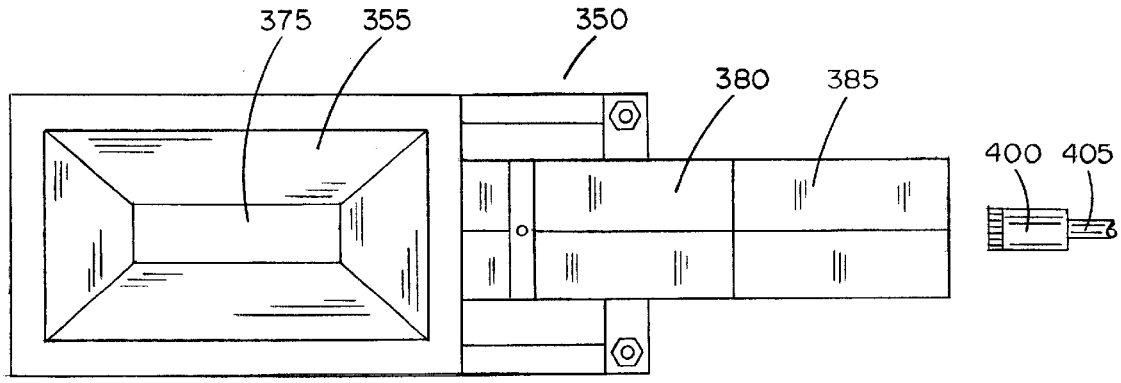
FIG. 20 is a top view of another embodiment of an apparatus according to the present invention.
Figure 21:
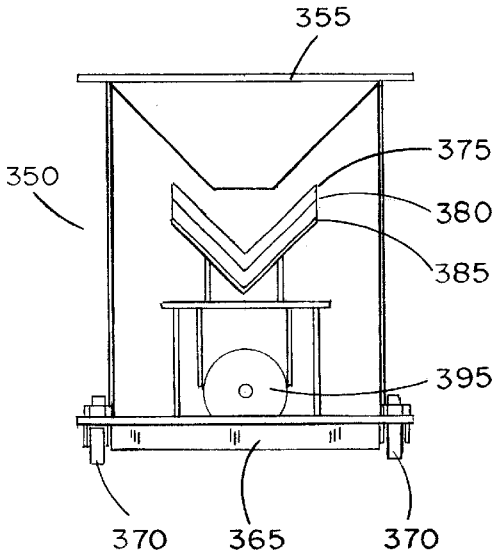
FIG. 21 is an end view of another embodiment of an apparatus according to the present invention.

FIG. 20 is a top view of an apparatus 350 of an embodiment of the present invention. FIG. 21 is an end view of an embodiment of an apparatus 350, showing the same features discussed with regard to FIG. 19. The end shown in FIG. 21 is the end to which the vacuum generator 400 is placed in proximity to the second section 387 of the second trough segment to transport the rejects.

Figure 22:
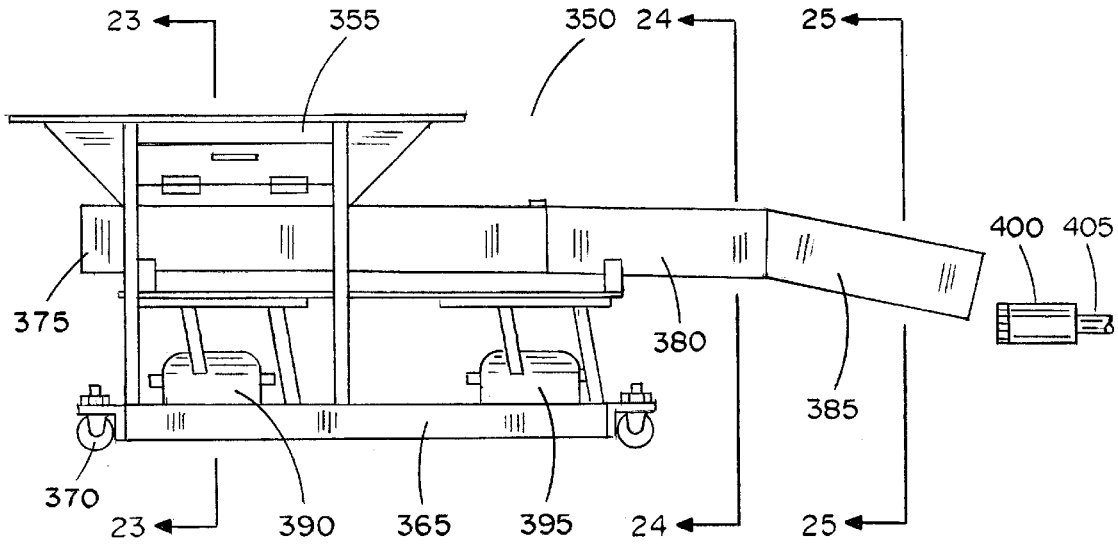
FIG. 22 is a side view of another embodiment of an apparatus according to the present invention.

FIG. 22 is a side view, showing the same features discussed with regard to FIG. 19. As seen in FIG. 22, the first trough segment 375 is substantially horizontal. The two sections of the second trough segment 380 have different pitches. The first section 385 of the second trough segment is substantially horizontal. The second section 387 of the second trough segment has a steeper pitch than the first section 385. The first trough segment 375 preferably overlays the second trough segment 380 by one inch such that cigarette rejects from the first trough segment are conveyed into the second trough segment without becoming trapped between the trough segments.

Figure 23:
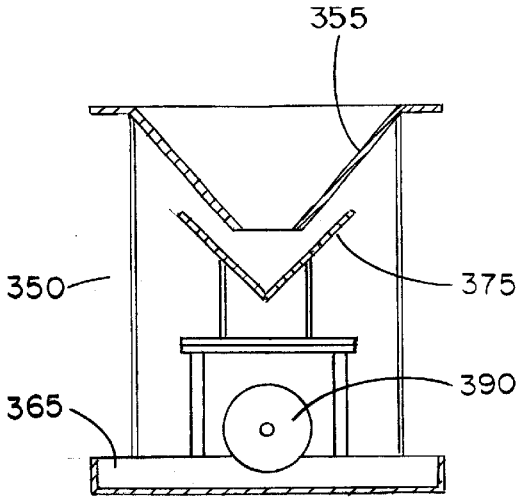
FIG. 23 is a cross-sectional view of the apparatus shown in FIG. 22 taken along the line 23—23.
Figure 24:
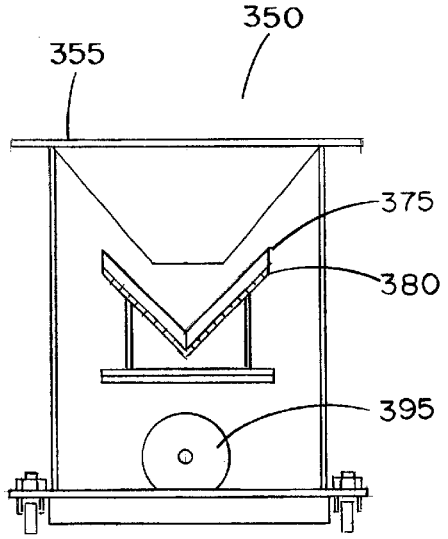
FIG. 24 is a cross-sectional view of the apparatus shown in FIG. 22 taken along the line 24—24.
Figure 25:
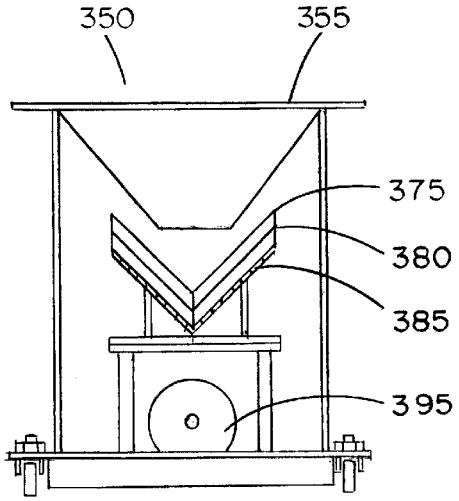
FIG. 25 is a cross-sectional view of the apparatus shown in FIG. 22 taken along the line 25—25.

FIG. 23 is a cross-sectional view of an embodiment of the apparatus 350 shown in FIGS. 19–22 and taken along the line 23—23 of FIG. 22. FIG. 23 shows a cross-section of the first trough segment 375. FIG. 24 is a cross-sectional view of an embodiment of the apparatus 350 shown in FIGS. 19–22 and taken along the line 24—24 of FIG. 23. FIG. 24 shows a cross-section of the first section 385 of the second trough segment 380 and the first trough segment 375. FIG. 25 is a cross-sectional view of an embodiment of the apparatus 350 shown in FIGS. 19–22 and taken along the line 25—25 of FIG. 23. FIG. 25 shows a cross-section of the second section of the second trough segment 387, the first section of the second trough segment 385 and the first trough segment 375. FIGS. 23–25 illustrate the overlap and interaction of the first trough segment 375 and the second trough segment 380.

Figure 26:
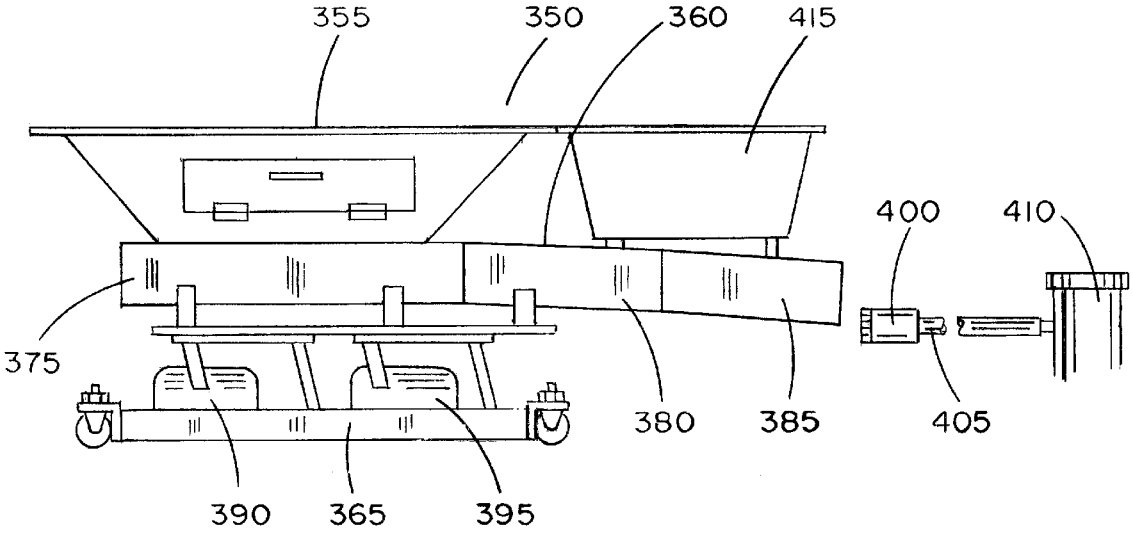
FIG. 26 is a side view of another embodiment of an apparatus according to the present invention.

FIG. 26 is a side view of an embodiment of an apparatus 350 of the present invention. The apparatus 350 as shown includes a trough 360 having two trough segments 375,380. A first driver 390 is attached to the first trough segment 375. A second driver 395 is attached to the second trough segment 380. The drivers 390,395 mechanically convey cigarette rejects that enter the trough 360 toward the vacuum generator 400. The vacuum generator 400 transports the cigarette rejects through a hose 405 to a predetermined location in the cigarette manufacturing process. In a preferred embodiment, the predetermined location in the cigarette manufacturing process is a cigarette opener and tobacco removal unit. Before the cigarette rejects reach the predetermined location in the cigarette manufacturing process, the rejects must be separated from the fluid stream. In the embodiment shown in FIG. 26, the rejects are separated from the fluid stream by separator 410. The separator 410 shown in FIG. 26 is not to scale and the break in the hose 405 illustrates that the hose 405 may vary in length depending on the distance to the predetermined location in the cigarette manufacturing process. An example of a separator useful in the present invention is shown and described in greater detail in FIGS. 17–18.

As shown in FIG. 26, a preferred embodiment of an apparatus of the present invention also includes a waste pan 415. In an embodiment of the present invention, the apparatus is positioned below a MAX 80 filter tipping machine (e.g., as shown in FIG. 9), which has an assembly section and an inspection section. The inspection section refers generally to the location where finished cigarettes are tested. Waste from the inspection section discharges from the bottom of the machine and is typically rejected cigarettes. The other section of the filter tipping machine, the assembly section, involves attaching filters to the tobacco rods. Waste from the assembly section (e.g., filter materials and filter paper) discharges out the bottom of the machine. Most of the waste from the assembly section is filter and paper waste that is to be discarded whether recovered below the filter tipping machine or at a tobacco removal unit. Thus, a waste pan 415 is preferably positioned on the apparatus below the assembly section to collect the filter and paper waste.

The trough 360 of the apparatus 350 shown in FIGS. 19–26 is preferably V-shaped and may be constructed of stainless steel or aluminum. With a V-shaped trough, the cigarette rejects are linearly aligned in the direction of movement (e.g., the lengths of the cigarette rejects are parallel to the length of the trough), which assists in their movement towards the vacuum generator. In an embodiment of an apparatus for use beneath a MAX 80 filter tipping machine, the trough may be approximately 42 inches long. In this embodiment, the first trough segment 375 is approximately 22 inches long with six inch sides. In this embodiment, the angle between the sides is 90° resulting in a distance between the tops of the sides of the first trough segment of 8.5 inches.

The second trough segment 380 preferably includes a first section 385 having a length of 10 inches with 5 inch sides. The second section 387 in this embodiment preferably has a length of 11 inches with 5 inch sides. In this embodiment, the angle between the sides is 90° resulting in a distance between the tops of the sides of the trough of approximately 7 inches. As noted above, in a preferred embodiment, the second section 387 of the second trough segment 380 has a steeper pitch than the first section 385 of the second trough segment 380. While the first section 385 is preferably horizontal, the second section may drop 1 inch over a distance of 11 inches resulting in a decline angle of 5.2°. By increasing the pitch of the second section 387, the cigarette rejects are accelerated through the trough 360 toward the vacuum generator 400. The first trough segment 375 overlays the second trough segment 380, preferably by about one inch.

The cigarette rejects are conveyed toward the vacuum generator by at least one driver attached to the trough. In the embodiment shown in FIGS. 19–26, two drivers 390,395 are attached to the trough 360. The drivers 390,395 mechanically convey the cigarette rejects by vibrating the trough segments 375,380 producing a lifting and throwing effect. The first driver 390, for the first trough segment 375, is preferably an Eriez Model 26C Vibratory Feeder 115V/60. The second driver 395, for the second trough segment 380, is preferably an Eriez Model 15A Vibratory Feeder 115/60. The drivers are preferably provided with speed control, such as a FT-115 control for each drive.

Rather than using a trough having two trough segments, another embodiment of the present invention may include a trough having three trough segments. Except as described below, the other features of this embodiment are the same as described above with regard to FIGS. 19–26. The first trough segment is substantially horizontal. The first trough segment overlays the second trough segment. The second trough segment has a steeper pitch than the first trough segment. The second trough segment overlays the third trough segment. The third trough segment has a steeper pitch than the second trough segment. A first driver is attached to the first trough segment. A second driver is attached to the second trough segment. The drivers mechanically convey the cigarette rejects toward a vacuum generator. The vacuum generator transports the cigarette rejects through a hose to a predetermined location in the cigarette manufacturing process. In a preferred embodiment, the predetermined location in the cigarette manufacturing process is a cigarette opener and tobacco removal unit.

In an embodiment of an apparatus for use beneath a MAX 80 filter tipping machine, the trough may be approximately 42 inches long with each side of the trough being 6 inches wide. In this embodiment, the angle between the sides is 90° resulting in a distance between the tops of the sides of the trough of 8.5 inches.

As noted above, in a preferred embodiment, the third trough segment 385 has a steeper pitch than the second trough segment and the second trough segment has a steeper pitch than a first trough segment. For example, the second trough segment may drop 0.5 inches over a distance of 9 inches resulting in a decline angle of 3.2°. The third trough segment may drop 1.6 inches over a distance of 11 inches resulting in a decline angle of 8.3°. As noted above, the first trough segment is preferably horizontal. By increasing the pitch of the trough segments, the cigarette rejects are accelerated through the trough toward the vacuum generator. The trough may be constructed of stainless steel or aluminum.

The cigarette rejects are primarily conveyed toward the vacuum generator by at least one driver attached to the trough. With a trough having three trough segments, two drivers are preferably used, one attached to the first trough segment and one attached to the second trough segment. The drivers mechanically convey the cigarette rejects by vibrating the trough segments producing a lifting and throwing effect. With a trough having a length of 42 inches and including three trough segments, suitable drivers would include two Model 26C 115/60 electromagnetic drives manufactured by Eriez. The drives are preferably provided with speed control, such as a NEMA 12 Model GS-115 control for each drive.

Figure 27:
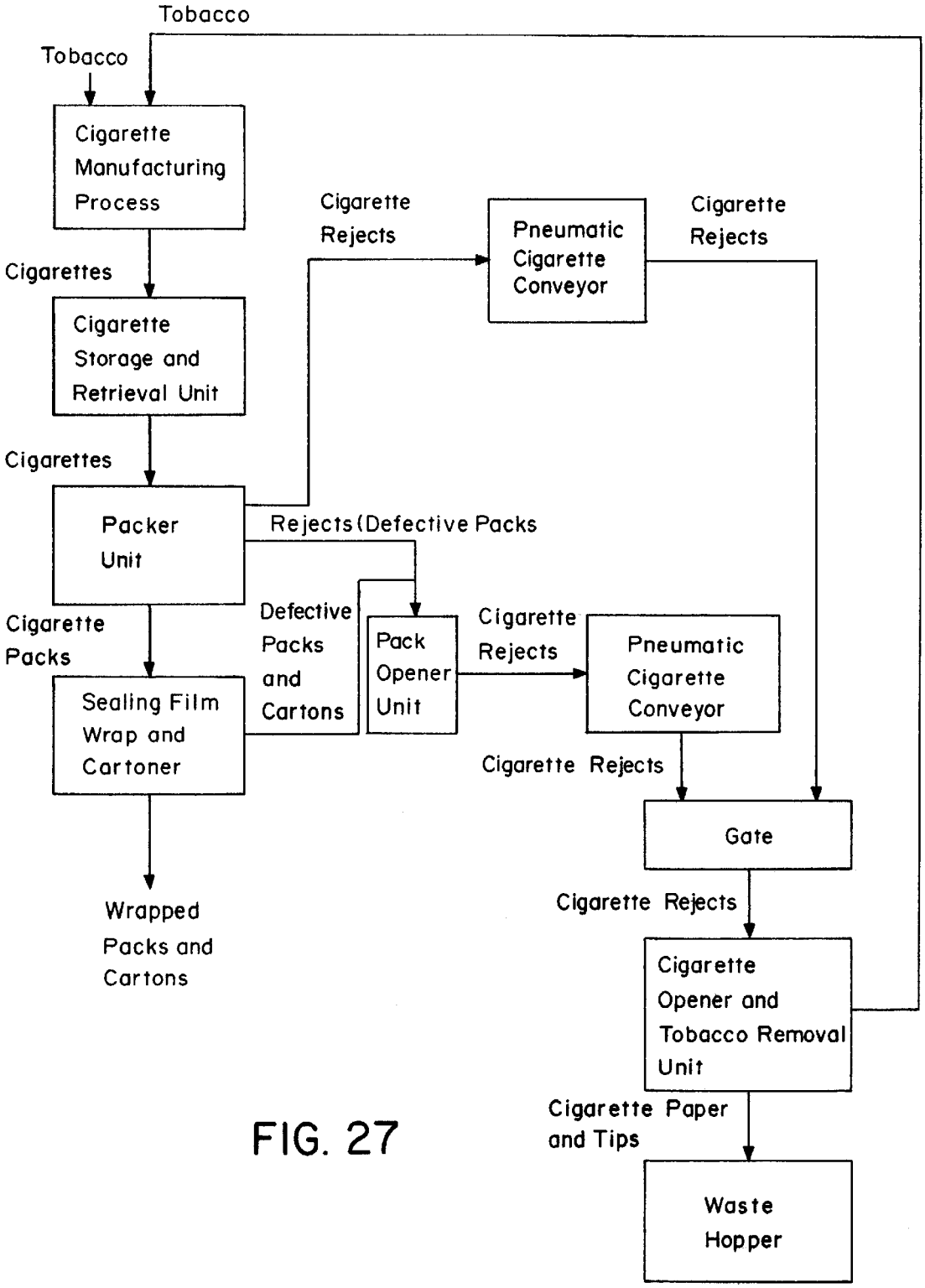
FIG. 27 is a flow chart showing the flow of tobacco and cigarettes in a cigarette manufacturing process utilizing an apparatus of the present invention.

FIG. 27 is a flow chart showing the flow of tobacco and cigarette materials in a cigarette manufacturing process utilizing an apparatus of the present invention. The cigarette manufacturing process is discussed in greater detail in the Background of the Invention section. The present invention may be advantageously utilized in conventional cigarette manufacturing processes. In FIG. 27, the apparatus is shown as a pneumatic cigarette conveyor, which simply refers to an apparatus for collecting and transporting cigarette rejects in a cigarette manufacturing process that utilizes air as the fluid stream. In general, the apparatus can be placed at any location where individual cigarettes need to be collected and transported to another location within the process. In FIG. 27, the apparatus is utilized to collect rejected cigarettes from the filter tipping machine and transport them to the tobacco removal unit, where the cigarettes are separated from the fluid stream, the cigarettes are opened, the paper and filter materials are separated from the tobacco, and the tobacco is sent to the hopper to be re-used in the manufacturing process. The tobacco removal unit may be of the type manufactured by and commercially available from Decouffle. A gate is provided at the entrance to the tobacco removal unit so that the hopper does not overflow. This gate is lowered into place to stop the flow of cigarettes to be opened if the rod maker is not operating, so that there is no accumulation of excess tobacco.

An apparatus of the present invention may also be used below a pack opener unit in a cigarette manufacturing process. Individual cigarettes are placed into packs at the packer unit and packs are placed into cartons at the cartoner. The packer unit may reject defective packs, which may then be shipped to a pack opener unit. Similarly, packs from rejected cartons at the cartoner may also be sent to a pack opener unit. At the pack opener unit, the packs are opened and the cigarettes are emptied. The cigarettes may be transported to a cigarette opener and tobacco removal unit using the process and apparatus of the present invention.

With respect to the descriptions set forth above, optimum dimensional relationship for the parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein.

The foregoing is considered as illustrative only of the principles of the invention. Since numerous modifications and changes will readily occur to those skilled in the art, the foregoing is not intended to limit the invention to the exact construction and operation shown and described, and all suitable modifications and equivalents falling within the scope of the appended claims are deemed within the present inventive concept.

The features of the present invention, together with the other objects of the invention, and along with the various features of novelty which characterize the invention, are pointed out with particularity in the claims annexed to and forming a part of this disclosure.

We claim:

1. An apparatus for receiving and transporting cigarette rejects in a cigarette manufacturing process, comprising:

a funneling tray;

a trough comprising at least two trough segments and having a first end and a second end;

a first driver attached to a first trough segment; and a vacuum generator positioned near the second end of the trough;

whereby cigarette rejects are guided into the trough by the funneling tray, the first driver vibrates the first trough segment to mechanically convey the cigarette rejects toward the vacuum generator, and the vacuum generator transports the cigarette rejects to a predetermined location in the cigarette manufacturing process.

2. The apparatus of claim 1, wherein the trough is V-shaped.

3. The apparatus of claim 1, further comprising a second driver attached to a second trough segment and the second trough segment comprises two sections, wherein a first section of the second trough segment is substantially horizontal and a second section of the second trough segment has a steeper pitch than the first section of the second trough segment.

4. The apparatus of claim 1, further comprising a waste pan resting on the trough.

5. The apparatus of claim 1, the predetermined location in the cigarette manufacturing process is a cigarette opener and tobacco removal unit.

* * * * *